United States Patent [19]

Bailey et al.

[11] Patent Number: 4,481,268

[45] Date of Patent: Nov. 6, 1984

[54] METHOD OF FORMING A PHOTOGRAPHIC DYE IMAGE

[75] Inventors: Joseph Bailey, Bushey Heath; David Clarke; Michael W. Crawley, both of Watford; Peter D. Marsden, North Harrow; Jasbir Sidhu, Harrow, all of England

[73] Assignee: Eastman Kodak Company, Rochester, N.Y.

[21] Appl. No.: 499,754

[22] PCT Filed: Sep. 2, 1982

[86] PCT No.: PCT/GB82/00263

§ 371 Date: Apr. 29, 1983

§ 102(e) Date: Apr. 29, 1983

[87] PCT Pub. No.: WO83/00939

PCT Pub. Date: Mar. 17, 1983

[30] Foreign Application Priority Data

Feb. 9, 1981 [GB] United Kingdom ..... 8126620

[51] Int. Cl.[3] ..... G03C 7/40

[52] U.S. Cl. ..... 430/17; 430/380; 430/383; 430/384; 430/386; 430/388; 430/440; 430/442; 430/473; 430/475; 430/483; 430/484; 430/487; 430/505; 430/551; 430/552; 430/556; 430/558; 430/955; 430/372

[58] Field of Search ..... 430/15, 17, 216, 226, 430/237, 241, 372, 383, 384, 386, 388, 440, 442, 473, 475, 483, 484, 487, 505, 551, 552, 556, 558, 955, 386

[56] References Cited

U.S. PATENT DOCUMENTS

| | | | |
|---|---|---|---|
| 2,339,213 | 1/1944 | Woodward et al. | 430/380 |
| 2,424,256 | 7/1947 | Schmidt et al. | 430/503 |
| 2,673,801 | 3/1954 | Jennen | 96/55.2 |
| 2,708,625 | 5/1955 | Sprung et al. | 430/380 |
| 2,846,307 | 8/1958 | Woolley | 96/55.2 |
| 2,872,317 | 2/1959 | Woolley | 430/376 |
| 2,913,338 | 11/1959 | Bates et al. | 430/372 |
| 2,964,402 | 12/1960 | Jennen et al. | 96/100 |
| 3,035,914 | 5/1962 | Schmidt et al. | 96/55 |
| 3,629,336 | 12/1971 | Idelson | 260/590 |
| 3,733,335 | 5/1973 | Anderson | 430/386 |
| 3,762,922 | 10/1973 | Lugosy et al. | 430/380 |
| 3,782,949 | 1/1974 | Olivares et al. | 430/484 |
| 3,816,134 | 6/1974 | Schellenberg | 96/55 |
| 3,907,875 | 9/1975 | Schellenberg | 260/501.19 |
| 4,242,429 | 12/1980 | Hara et al. | 430/17 |
| 4,252,959 | 2/1981 | Spitzner | 546/306 |
| 4,301,223 | 11/1981 | Nakamura et al. | 430/551 |
| 4,343,886 | 8/1982 | Nakamura et al. | 430/237 |
| 4,386,155 | 5/1983 | Bergthaller et al. | 430/372 |

FOREIGN PATENT DOCUMENTS

| | | |
|---|---|---|
| 1119667 | 12/1961 | Fed. Rep. of Germany . |
| 2100538 | 7/1971 | Fed. Rep. of Germany . |
| 2128800 | 10/1972 | France . |
| 2164220 | 7/1973 | France . |
| 663190 | 12/1951 | United Kingdom . |
| 720284 | 12/1954 | United Kingdom . |
| 722281 | 1/1955 | United Kingdom . |
| 778089 | 7/1957 | United Kingdom . |
| 790327 | 2/1958 | United Kingdom . |
| 875470 | 8/1961 | United Kingdom . |
| 1285432 | 8/1972 | United Kingdom . |
| 1416699 | 12/1975 | United Kingdom . |
| 2008141A | 5/1979 | United Kingdom . |

OTHER PUBLICATIONS

*Research Disclosure*, Dec. 1978, Item No. 17643.

*Primary Examiner*—J. Travis Brown
*Attorney, Agent, or Firm*—Richard E. Knapp

[57] ABSTRACT

A method of forming a photographic azo or azamethine dye image in an exposed photographic silver halide element, the method of comprising the steps of (a) developing the imagewise exposed material to form an imagewise pattern of oxidized color developing agent, (b) reacting the oxidized color developing agent with a color coupler to produce an image dye, characterized in that at least one of the color developing agent and the color coupler possesses a metal chelating site such that the image dye is capable of forming a bi-, tri- or higher-dentate metallized dye, and (c) contacting the image dye with polyvalent metal ions to form a metallized dye image. Specified color developing agents include heterocyclic substituted hydrazides and specified couplers include benziso-oxazolones and 2H-pyrazolo-[3,4-b]pyridines in addition to more conventional compounds.

18 Claims, No Drawings

METHOD OF FORMING A PHOTOGRAPHIC DYE IMAGE

This invention relates to methods of forming a photographic dye image.

The photographic colour development process relies on the imagewise development of an exposed silver halide layer with a colour developing agent. The oxidized colour developing agent so formed then couples with a colour coupler to form an image dye. The literature of this process is vast and many references to the couplers and developers used in this process of colour photography are given in Bailey and Williams, The Photographic Color Development Process, Chapter 6, The Chemistry of Synthetic Dyes, Vol. 4, Ed. K. Venkataraman, Academic Press.

It is customary in presently available photographic colour materials to form azamethine dyes but proposals for the formation of azo dyes by photographic colour development have been made. Such proposals include the use of indazolone and 2-ethoxycarbonylindazolin-3-one couplers in British Patent Specifications Nos. 663,190 and 722,281 respectively while the use of isoxazolone couplers is described in British Patent Specification No. 778,089.

Dye images formed in the photographic colour development process have always displayed less than ideal fastness properties and although improvements have been made over the years, better fastness properties have always been desired.

It is known from the textile dye field and more recently in the photographic field from U.S. Pat. No. 4,142,891 that tridentate metallised azo dyes having chelating groups located adjacent each end of the azo linkage show superior fastness properties compared to their unmetallised counterparts.

The prior art describing the formation of image dyes by colour coupling development do not describe the formation of metallised dye images, nor do they describe the formation of dyes capable of forming tri- or higher-dentate metallised dye complexes.

The present invention now provides a method whereby photographic images of superior fastness properties are produced by a colour coupling development process which leads to the formation of dyes which are bi-, tri- or higher-dentate metal complexes.

According to the present invention there is provided a method of forming a photographic azo or azamethine dye image in an imagewise exposed photographic silver halide material, the method comprising the steps of (a) developing the imagewise exposed material to form an imagewise pattern of oxidised colour developing agent, (b) reacting the oxidised colour developing agent with a colour coupler to produce an image dye, characterized in that at least one of the colour developing agent and the colour coupler possesses chelating sites such that the image dye is capable of forming a bi-, tri- or higher-dentate metallised dye, and (c) contacting the image dye with polyvalent metal ions to form a metallised dye image.

The present invention also provides processed photographic elements containing metallised dye images formed by colour coupling development in accordance with the above method.

The colour couplers and colour developing agents can be known compounds, or known compounds can be modified for use in this invention. To be suitable for use in this invention at least one, and preferably both, of the coupler and the developing agent should possess a metal chelating group in such a location that, following coupling, a coordination complex can be formed between the chelating group or groups, the metal ion and nitrogen atom in the azo or azamethine linkage of the dye.

The metal chelating group can be any atom or moiety which will donate a pair of electrons to the metal ion used for metallisation. Preferred chelating groups contain a nitrogen or oxygen atom which forms the chelating site. Preferred chelating groups include hydroxy, amino, carboxy, sulfonamido and sulfamoyl as well as salts and hydrolyzable precursors of such groups.

Useful colour developing agents include phenylene diamines, aminophenols and arylhydrazides. If the developing agent is intended to be used with a colour coupler which does not possess a chelating group, the developing agent should possess such a group, preferably ortho to the nitrogen atom (e.g. in or attached to the 2-position of a phenylene diamine).

Useful colour couplers include phenols, naphthols, pyrazolones, pyrazolotriazoles and open chain ketomethylene compounds as well as other couplers illustrated below. If the developing agent intended to be used to form a dye image with the colour coupler does not possess a chelating group, then the colour coupler should have one, preferably attached to one of the positions adjacent the coupling position.

In a preferred embodiment of this invention, both the colour coupler and the colour developing agent each possess at least one chelating group so that following coupling a tri-/ or higher-dentate metallised dye can be formed.

In one embodiment of the invention a metallisable azo dye is formed using a colour coupler of the formula:

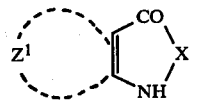

I wherein

X is —O— or =NY in which Y is $—COR^1$, $—COOR^1$, $—SO_2R^2$, $—CONR^2R^3$ or $—CSNHR^2$, the residue of X preferably forming a chelating group after coupling, $R^1$ is an alkyl group of 1–4 carbon atoms, $R^2$ is an alkyl, preferably having 1–20 carbon atoms, which is optionally substituted, (e.g. with —COOH, $—SO_2N(R^{19})_2$, —OH, $—SO_3H$, aryl or substituted aryl groups), or an aryl, preferably having 6–20 carbon atoms, which is optionally substituted (e.g. with —Br, —Cl, —F, $—NO_2$, —COOH, $—SO_3H$, $—SO_2N(R^{19})_2$, or alkyl having 1–4 carbon atoms), $R^3$ is H or an optionally substituted alkyl or aryl group as specified for $R^2$, each $R^{19}$ is H or an optionally substituted alkyl or aryl group as specified for $R^2$ or together they may form a heterocyclic ring, (e.g. morpholine or piperidine), $Z^1$ represents the atoms necessary to complete a diffusible or non-diffusible coupler capable of forming a non-diffusible azo dye on coupling with an oxidised colour developing agent.

Examples of couplers of formula I include

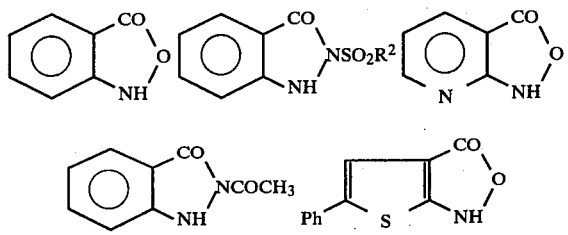

all of which optionally contain ballasting groups to render them non-diffusible wherein $R^2$ is as defined above and Ph is a phenyl group. One coupling with, for example, oxidised N,N-diethyl-p-phenylenediamine or an appropriately substituted N,N-diethyl-p-phenylenediamine, they form azo dyes as follows:

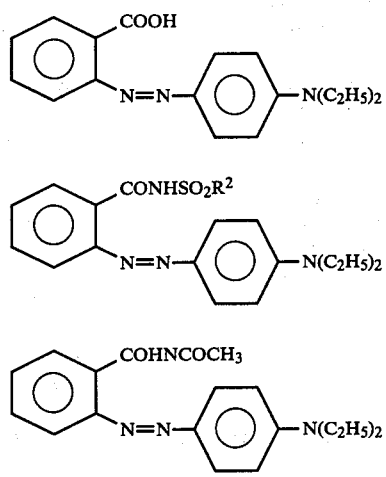

In another embodiment of the invention a metallisable azo dye is formed using a colour coupler of the formula:

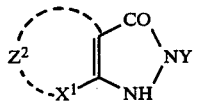

II wherein $X^1$ is —N= or

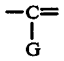

where G is a chelating group, a salt thereof or a hydrolysable precursor thereof, Y is $—COR^1$, $—COOR^1$, $—SO_2R^2$, $—CONR^2R^3$ or $—CSNHR^2$, $R^1$, $R^2$ and $R^3$ are as defined above, $Z^2$ represents the atoms necessary to complete a diffusible or non-diffusible coupler capable of forming a non-diffusible azo dye on coupling with an oxidised colour developing agent.

Examples of couplers of formula II include 2-acetylindazolones of the formula:

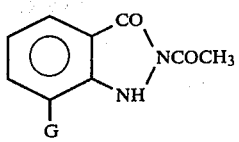

wherein G is as defined above and the 1H-pyrazolo[3,4-b]pyridine compound of the formula:

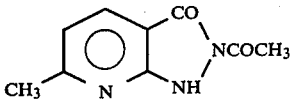

both of which optionally contain ballasting groups to render them non-diffusible, and which couple with, for example, oxidised N,N-diethyl-2-carboxy-p-phenylenediamine to form the following azo dyes:

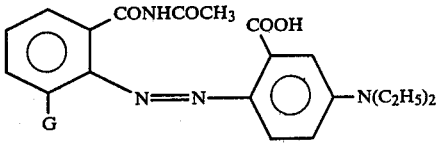

and

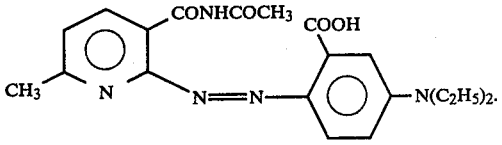

One class of colour developing agents which is especially useful in conjunction with couplers of formula I or II have the general formula:

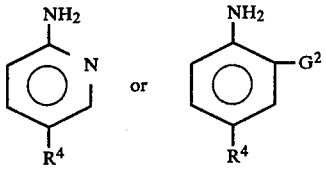

(III) (IV)

wherein $R^4$ is —OH or $—NR^2R^3$ ($R^2$ and $R^3$ being as defined above) and $G^2$ is a chelating group.

Examples of groups which $G^2$ may represent are —COOH, —OH, $—NHSO_2R^2$, $—CH_2OH$ and $—CH_2NH_2$.

In another embodiment of the present invention a metallisable azamethine dye is formed by using a colour developing agent of formula (IV) above together with a suitable coupler. For example, a coupler of the formula:

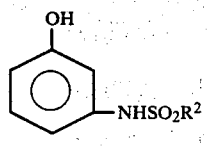

forms a metallisable indoaniline or indophenol dye with developing agent of formula IV in which G is carboxy as follows:

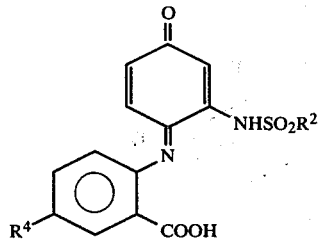

Such a dye may be metallised, e.g. with nickel, to form a dye of the formula:

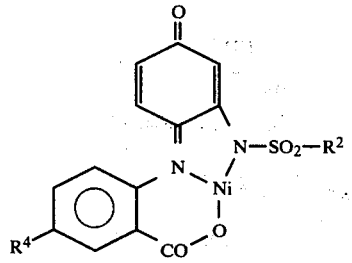

wherein the coordination number of nickel could be satisfied by further ligands such as by the formation of a 2:1 dye:metal complex.

In a further embodiment of the invention the colour developing agent is a hydrazide of the formula:

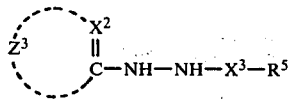

V wherein $R^5$ is an alkyl, preferably having 1–20 carbon atoms, aryl, preferably having 6–20 carbon atoms or heterocyclic group all of which are optionally substituted, (e.g. as exemplified for $R^2$), $X^2$ is —N= or

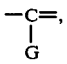

$X^3$ *is —CO— or, preferably,* $—SO_2—$, $Z^3$ represents the atoms necessary to complete an aromatic carbocyclic or heterocyclic nucleus which is optionally substituted, and G is as defined above, If the developing agents of formula V are ballasted the ballast group may be present in either $Z^3$ or $R^5$.

Examples of $R^5$ groups are methyl, phenyl, p-methyl-, p-chloro- or p-nitrophenyl, 3-chloro-5-nitrophenyl, or 2-, 3- or 4-pyridyl. Examples of nuclei which $Z^3$ may complete are pyridine, pyrimidine, quinoxaline, pyrazine, quinazoline and thiophene nuclei.

The developing agents of formula V couple, inter alia, with appropriate conventional couplers, e.g. phenol, naphthol, pyrazolone, 1H-pyrazolo[3,2-c]-s-triazole or open chain ketomethylene couplers, to form a bi-, tri- or higher-dentate azo dye. An example of such a coupling reaction is as follows:

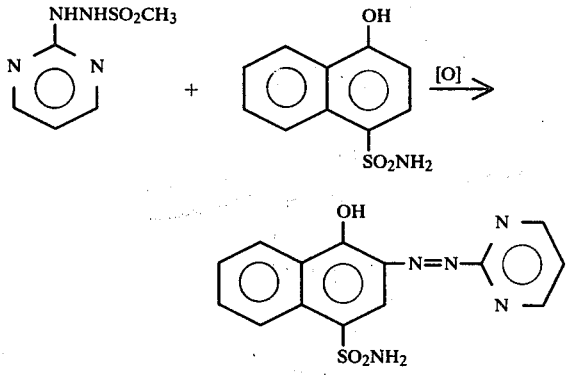

Preferred groups of developing agents of formula V have the formulae:

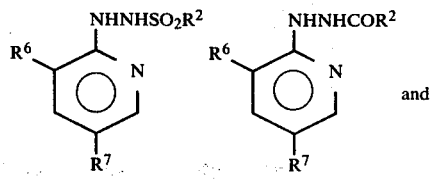

VI VII

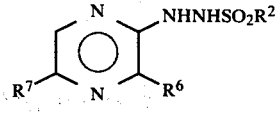

VIII

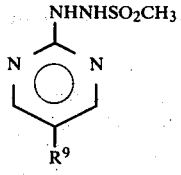

(IX)

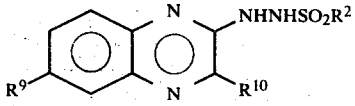

(X)

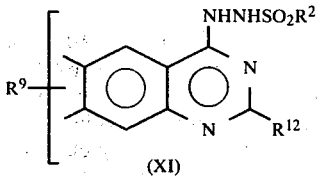

(XI)

-continued

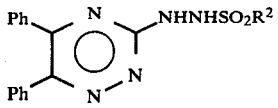

(XII)

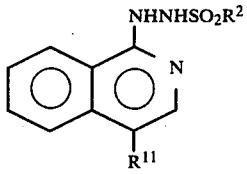

(XIII)

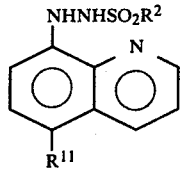

(XIV)

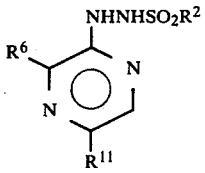

(XV)

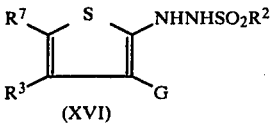

(XVI)

wherein $R^6$ is hydrogen or alkoxy, preferably having 1–20 carbon atoms, e.g. methoxy, $R^7$ is $—NO_2$, $—SO_2R^8$ or $—COR^2$, $R^8$ is a tertiary amino group, preferably a piperidino group, $R^9$ is hydrogen or $—NO_2$, $R^{10}$ is alkyl or alkoxy, preferably containing 1–20 carbon atoms, e.g. $—CH_3$ or $—OCH_3$, $R^{11}$ is H, $—NO_2$ or $—SO_2N(R^2)_2$, $R^{12}$ is H, aryl, substituted aryl, alkyl, substituted alkyl, (e.g. as exemplified for $R^2$ or $—CF_3$), heterocyclic, (e.g. 2-pyridyl), or —CN, $R^3$, $R^6$, G and each $R^2$ are as defined above.

Especially preferred developing agents of the above classes are those having the formulae VI, X, XI and XII.

Examples of preferred values for $R^2$ in the above formulae include $—CH_3$, $—C_4H_9$—n, $—C_{16}H_{33}$—n, phenyl, o- or p-methyl-, o- or p-chloro- and o- or p-nitro-phenyl.

In addition to the conventional colour couplers mentioned above, the sulphonylhydrazide developing agents and, in most cases the conventional p-phenylenediamine and p-aminophenol developing agents, will couple with the following classes of coupler compounds of formulae XVII or XXXV although the couplers may not necessarily couple in the same position with the sulfonylhydrazides as they do with the conventional developing agents.

$R^{13}—CH_2—CONH—R^5$ (XVII)

$R_{14}OCO—CH_2—COOR^{14}$ (XVIII)

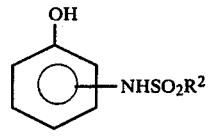

(XIX)

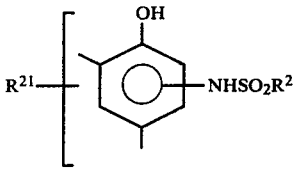

(XX)

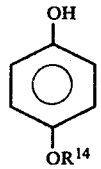

(XXI)

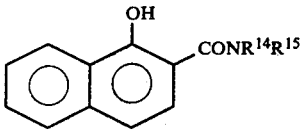

(XXII)

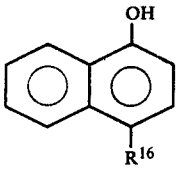

(XXIII)

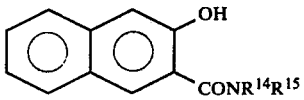

(XXIV)

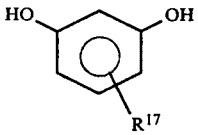

(XXV)

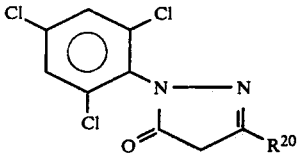

(XXVI)

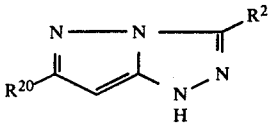

(XXVII)

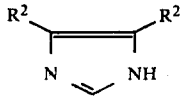

(XXVIII)

-continued (XXIX)

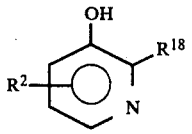

(XXX)

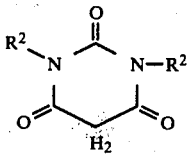

(XXXI)

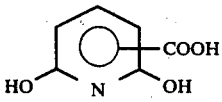

(XXXII)

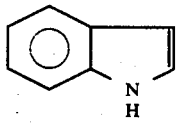

(XXXIII)

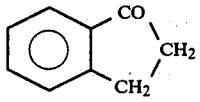

(XXXIV)

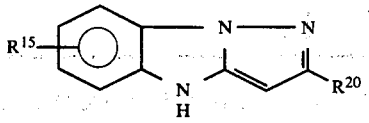

(XXXV)

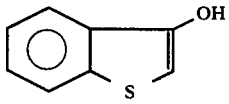

wherein $R^{13}$ is $R^5$—NHCO—, —CN, $R^{14}$—O—CO—,

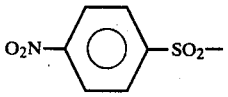

$R^5NHSO_2$—, $R^5CO$— or p-nitrophenylsulphonyl, $R^{14}$ is an alkyl, preferably having 1–20 carbon atoms, which is optionally substituted, (e.g. with —COOH, —$SO_2N(R^{19})_2$, —OH, —$SO_3H$, aryl or substituted aryl groups), $R^{15}$ is hydrogen or an alkyl or aryl both of which are optionally substituted, (e.g., as specified for $R^2$), or where $R^{14}$ and $R^{15}$ are joined to the same nitrogen atom, they may together form a heterocyclic ring, (e.g. morpholine or piperidine), $R^{16}$ is —O—$R^{14}$ or —$SO_2NH$—$R^{15}$, $R^{17}$ is $R^{14}$ or —$CONHR^{14}$, $R^{18}$ is —OH or —$NH_2$, $R^{20}$ is $R^2$, —$NHCOR^2$ or —$NHR^2$, $R^{21}$ is halogen or an alkyl or alkoxy, preferably having 1–20 carbon atoms, which is optionally substituted, e.g. with —COOH, —$SO_2N(R^{19})_2$, —OH, —$SO_3H$, aryl or substituted aryl groups.

$R^5$ and each $R^2$ are as defined above.

Especially preferred couplers have the formulae XVII, XIX, XX, XXIII and XXV.

Specific sulphonyl hydrazide developing agents are listed below in Table I. All alkyl groups in this and other tables are normal (unbranched) unless otherwise specified.

TABLE I

1.

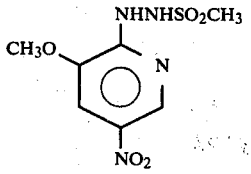

2.

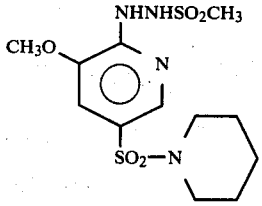

3.

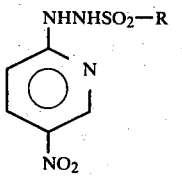

R = —$CH_3$, —$C_4H_9$, —$C_{16}H_{33}$,

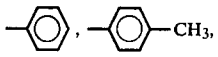

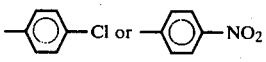

4.

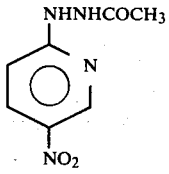

5.

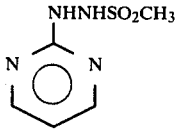

6.

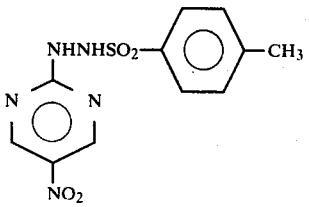

TABLE I-continued
7.
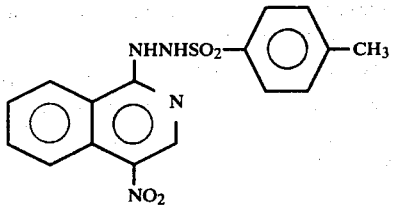
8.
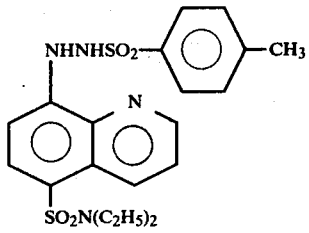
9.
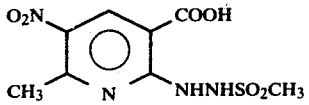
10.
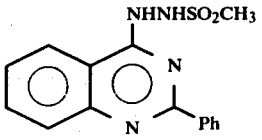
11.
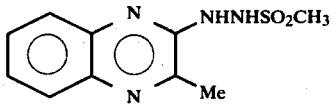
TABLE I-continued
12.
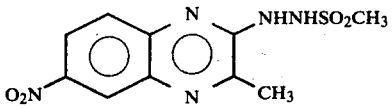
13.
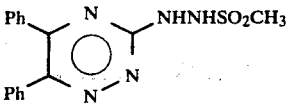
14.
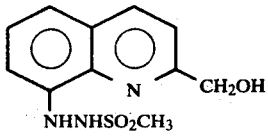
15.
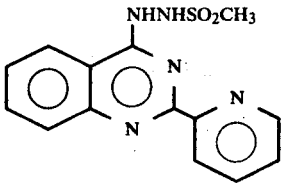
16.
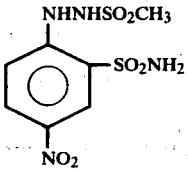
Specific couplers of formulae XVII to XXXV are listed below in Table II.
TABLE II
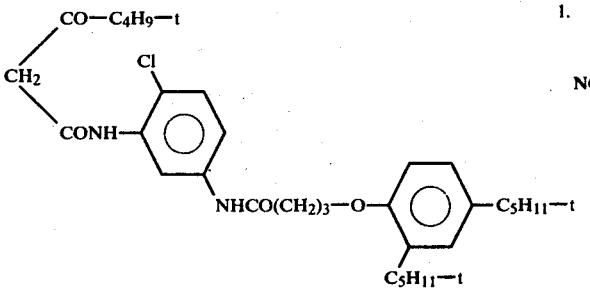
1.
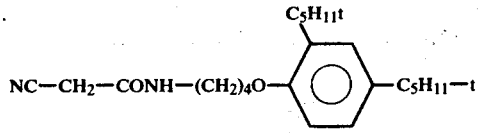
2.
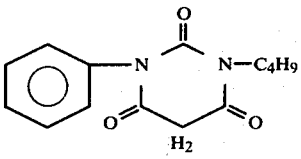
3.
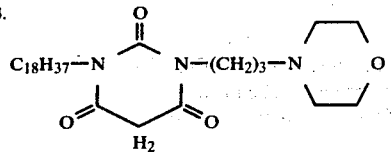
4.
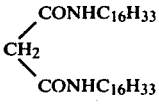
5.
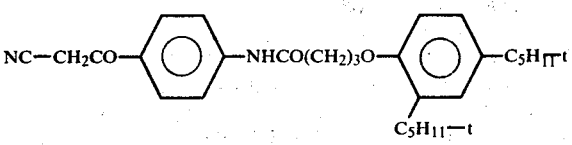
6.

TABLE II-continued
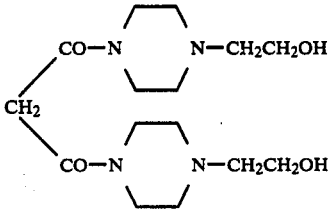
7.
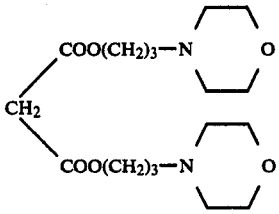
8.
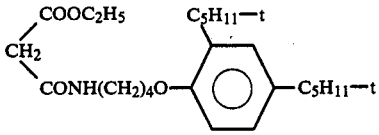
9.
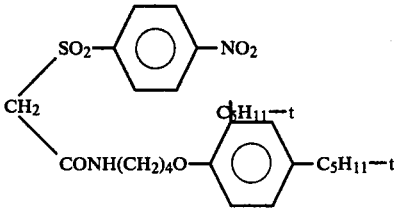
10.
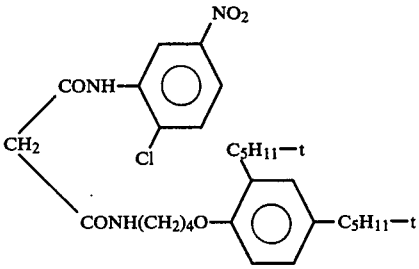
11.
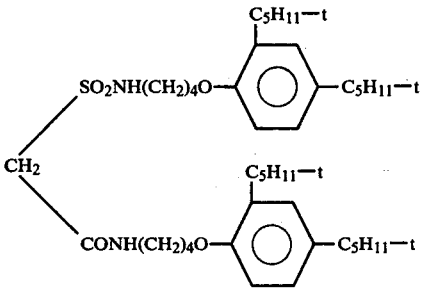
12.
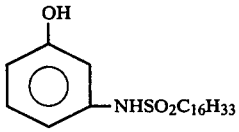
13.
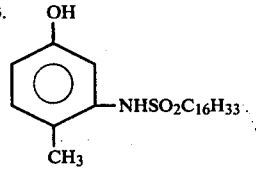
14.
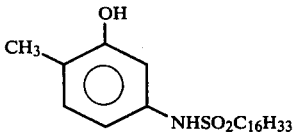
15.
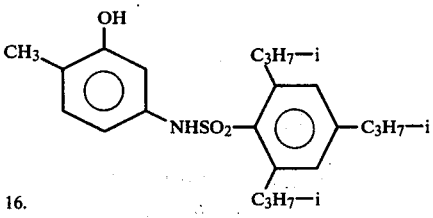
16.
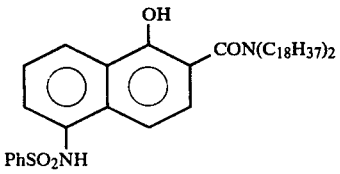
17.
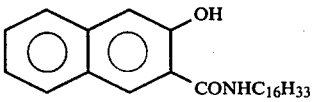
18.
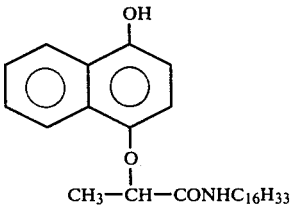
19.
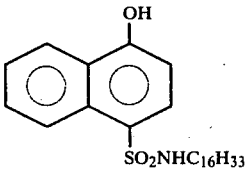
20.

TABLE II-continued
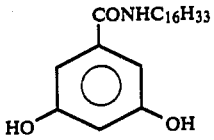
21.
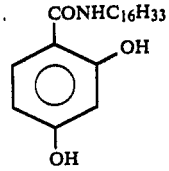
22.
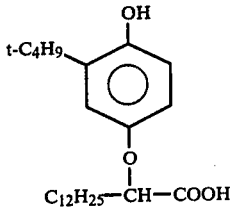
23.
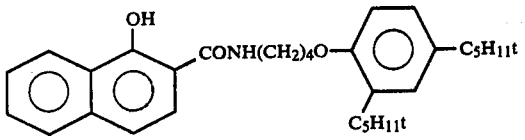
24.
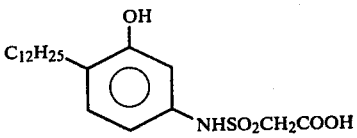
25.
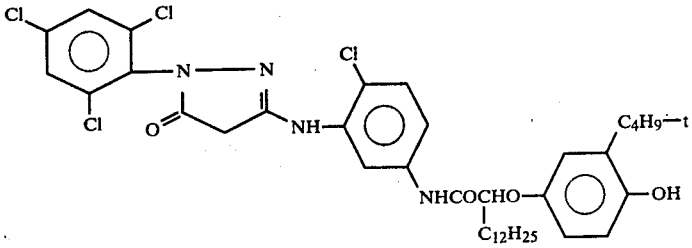
26.
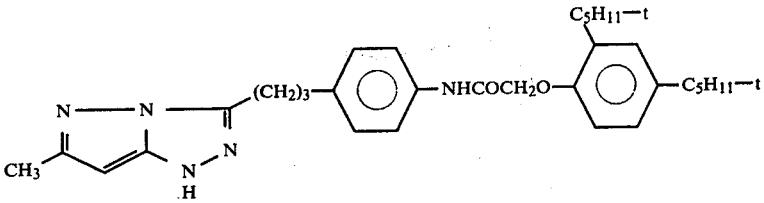
27.
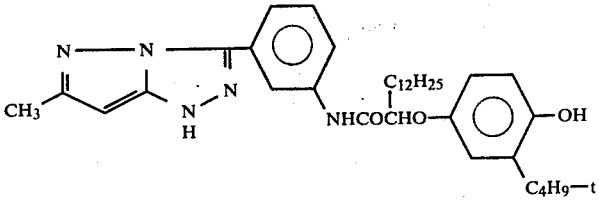
28.
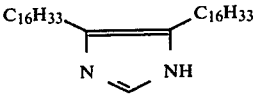
29.
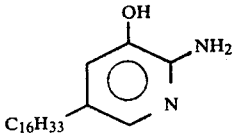
30.
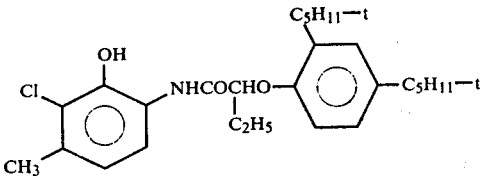
31.
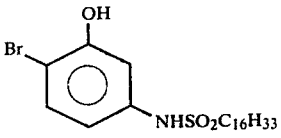
32.

TABLE II-continued

| | | |
|---|---|---|
| 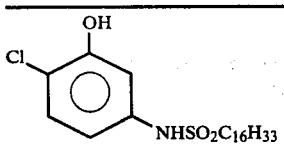 | 33. 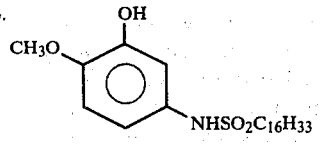 | 34. |
| 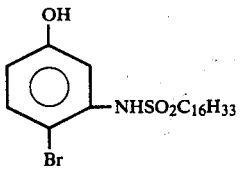 | 35. 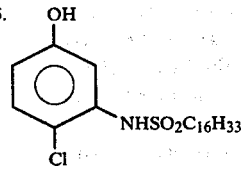 | 36. |
| 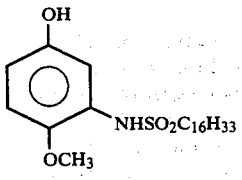 | 37. | |
| 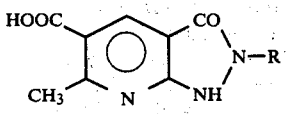 | 38. | R is H, $-COOC_2H_5$, $-COCH_3$ |
| 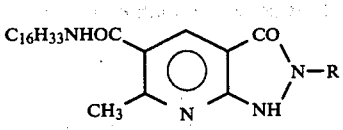 | 39. | |

The couplers and developing agents to be used in the present process may be prepared by organic preparative methods which are, in themselves, known. In particular benzisoxazolone couplers may be prepared as described in British Specification No. 778,089. Typical pyrazolone couplers may be prepared as described in British Specification No. 1,183,515 or U.S. Pat. No. 3,519,429 while typical β-keto-amide couplers may be prepared as described in British Specification No. 1,078,838 or U.S. Pat. No. 3,384,657. Typical pyrazolotriazole couplers may be prepared as described in British Specifications Nos. 1,252,418, 1,334,515, 1,340,191, 1,458,377 and Research Disclosure 12443 (1974).

The couplers and the colour developing agents employed herein may each be incorporated in the photographic material or dissolved in one of the processing solutions employed. A conventional arrangement is to incorporate ballasted coupler in the photographic material and to dissolve the developing agent in the developer solution.

In selecting a combination of colour developing agent and colour coupler for use in the present invention, it must be borne in mind that at least one of them and preferably both, should provide a chelating group adjacent to the azo or azamethine group in the image dye to be formed. The azo or azemethine groups themselves also act as coordinating sites thus forming bi or tri-dentate dyes. The structures of these reactants should be chosen so that, with the chelated metal ion, a 5- or 6-membered ring is formed with bi-dentate dyes and 5,5 5,6 or 6,6 two ring systems are formed with tridentate dyes.

In a preferred embodiment of the present invention the photographic material will have three colour forming units designed to produce a multicolour image. Such materials conventionally contain image-forming units sensitive to blue, green and red light capable of forming yellow, magenta and cyan dye images respectively. Each colour forming unit can be comprised of a single emulsion layer or of multiple emulsion layers sensitive to a given region of the spectrum. The layers of the element, including the layers of the colour-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. patent application Ser. No. 184,714 filed Oct. 1, 1980 now U.S. Pat. No. 4,362,806, issued Dec. 7, 1982.

A typical multicolor photographic element would comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive siler halide emulsion layer having associated therewith at least one yellow dye-forming coupler. The element can contain additional layers, such as metal providing layers, filter layers, interlayers, overcoat layers, subbing layers and the like.

The metal ions which may be employed to form the metal complex dyes are preferably ions of copper, nickel, chromium, cobalt, manganese or zinc. Metallisation may be achieved by incorporating a metal ion, preferably a metal ion which is chelated, in the photographic material. Best results will be obtained if the incorporated metal ion is kept away from the dye-forming reactants until after dye formation has occurred. Preferably, however, metallisation is effected by treatment with a solution containing metal ions. This solution may be the colour developer itself or preferably a subsequently used processing solution, for example an alkaline fix, or separate metallising solution. Metallisation can take place at pH 5.0–12.0 and at normal processing temperatures but usually metallisation will be more efficient at elevated temperatures and under alkaline conditions, e.g. pH 9.5–12.

Metal compounds may simply be dissolved in a processing solution, e.g. a fix solution, hence water-soluble salts may be used, for example, nickel sulphate or copper sulphate. A preferred separate metallising solution contains nickel or copper sulphate together with ammonium hydroxide at pH 11. The metal ions are preferably used at a concentration of from 0.1 to 100, preferably 1 to 15 g ion/liter.

The degree of metallisation can be improved by adding cationic surfactant to the metallising solution, for example benzyltributylammonium bromide, cetylpyridinium chloride, benzyltriphenylphosphonium chloride or cetyltrimethylammonium bromide which may be employed at concentrations of from 1 to 75, preferably 2 to 15 g/liter.

The colour development step may be carried out with a conventional colour developer solution containing an appropriate colour developing agent preferably at a pH of 10.5 to 12, especially at pH 11–11.6. Alternatively the colour developing agent may be incorporated in the photographic material and an alkaline activator used having a pH of 12.5–14.

It has been found that in many cases the presence of an electron transfer agent or development accelerator aids development and, with certain developing agents, is essential to the present colour development step. This is particularly so with the sulphonyl hydrazide developing agents and especially with the quinazoline compounds of formula XI. Examples of electron transfer agents are pyrazolidinones, for example 4-hydroxymethyl-4-methyl-1-phenylpyrazolidin-3-one which may be employed at concentrations of 0.05–5.0 preferably 0.1–1.0 g/liter. Examples of development accelerators are N-benzyl-α-picolinium bromide and bispyridinium methyl ether perchlorate which may be employed at concentrations of 0.2–10 preferably 1.0–5.0 g/liter.

The photographic silver halide materials to be used in the present invention may be of any of the structures and contain any of the additives as are described in Research Disclosure Item 17643 December 1978, published by Industrial Opportunities Ltd., Havant, Hampshire, U.K.

Development is followed by the conventional steps of bleaching, fixing, or bleach-fixing, to remove silver and silver halide, washing and drying. As indicated above, metallization can be performed during development or at any point in the process subsequently to development.

The following Preparations describe the preparation of compounds useful in the present invention.

DEVELOPING AGENTS

Preparation 1 (Method 1)

N'-(4-Nitro-2-sulphamoylphenyl)methanesulphonylhydrazide

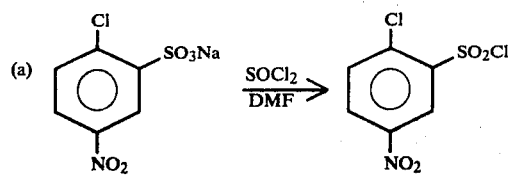

MWt. 259.5 MWt. 256

Sodium 2-chloro-5-nitrobenzenesulphonate (104 g, 0.4 mole) was added to thionyl chloride (240 ml ) and dimethylformamide (8 ml) added dropwise with cooling and vigorous stirring. After the initial vigorous reaction had subsided the mixture was stirred for 2 hours at 50° C. and then at 90° C. for 3 hours. The cooled mixture was poured onto a mixture of ice and water (4 l), the precipitate was filtered off, washed and then dried. The yield of crude product was 70 g, 68%. TLC analysis ($CH_2Cl_2$) showed one spot of $R_f$=0.8. Spectroscopic data was consistent with 2-chloro-5-nitrobenzenesulphonyl chloride which was used crude in the next stage.

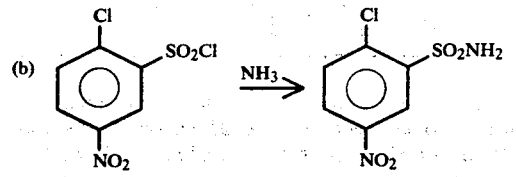

MWt. 256 MWt. 236.5

2-Chloro-5-nitrobenzenesulphonyl chloride (5.12 g, 20 mmole) was added in portions to liquid ammonia with stirring at −78° C. (methanol/dry-cold). The mixture was stirred for 0.5 h. and the excess ammonia then allowed to evaporate. The residue was crystallised from aqueous ethanol (1:1) to afford lustrous prisms of 2-chloro-5-nitrobenzenesulphonamide, 4.42 g, 93%, (m.p. 180°–187° C.). TLC analysis ($CH_2Cl_2$) showed one spot ($R_f$=0.2). Spectroscopic data was consistent with the product.

$C_6H_5ClN_2O_4S$: Requires: C 30.4%, H 2.1%, N 11.8%. Found: C 30.3%, H 2.05%, N 11.7%.

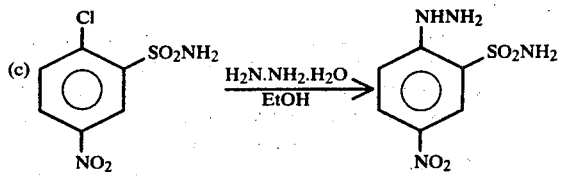

MWt. 236.5 MWt. 232

2-Chloro-5-nitrobenzenesulphonamide (3.35 g, 14.2 mmole) was dissolved in ethanol (75 ml) with heating and hydrazine hydrate (5 ml. 100 mmole) added. The mixture was refluxed for 45 minutes and then allowed to cool to room temperature. The product cystallised in long needles, 2.4 g. A second crop was obtained on cooling the filtrate in an ice bath, 0.5 g. The combined crops were recrystallised from water (120 ml) to afford pure 2-hydrazino-5-nitrobenzenesulphonamide, m.p. 209°-210° C., 1.85 gm, 60% as orange-yellow needles. TLC analysis (EtOAc:petrol, 1:1) showed one spot ($R_f$=0.3). Spectroscopic data was consistent with the product.

$C_6H_8N_4O_4S$: Requires: C 31.0%, H 3.45%, N 24.1%, S 13.8%. Found: C 30.8%, H 3.4%, N 24.3%, S 13.6%.

(d)

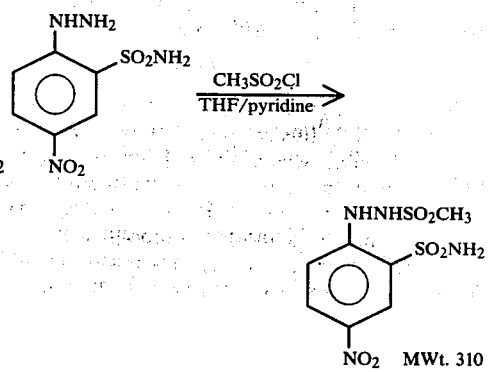

MWt. 232 MWt. 310

2-Hydrazino-5-nitrobenzenesulphonamide (1.30 g, 5.6 mmole) was dissolved in dry tetrahydrofuran (25 ml) and pyridine (2 ml). Mesyl chloride (1.28 g, 11.2 mmole) was added dropwise with stirring, the mixture stirred for a further 2 h, and then poured into stirred water (250 ml) cooled to 0°-5° C. The solid was filtered off, 1.47 g, and crystallised from water (100 ml) to afford pure n'-(4-nitro-2-sulphamoylphenyl)methanesulphonyl hydrazide, m.p. 211°-212° C. (dec), 1.1 g, 63% as long orange needles. TLC analysis (EtOAc) showed one spot ($R_f$=0.7). Analysis indicated the product crystallises as the hemi-hydrate, and was confirmed by spectroscopic data.

$C_7H_{10}N_4O_6S_2.\frac{1}{2}H_2O$: Requires: C 26.3%, H3.45%, N17.55% S 20.1%. Found: C 26.5%, H3.5%, N17.45% S 19.4%.

Preparation 2 (Method 1)

N'-(5-nitro-2-pyridyl)methanesulphonhydrazide

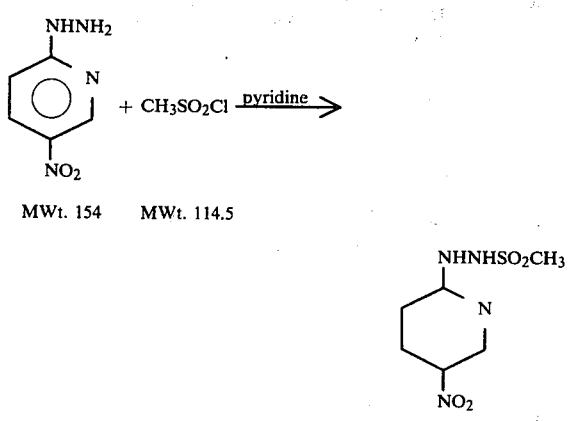

MWt. 154 MWt. 114.5

MWt. 232

5-Nitro-2-pyridylydrazine (10.6 g, 69 mmole) was suspended in pyridine (70 ml), cooled to −10° C. and methanesulphonyl chloride (7.9 g, 69 mmole) added dropwise with vigorous stirring. A clear yellow-orange solution was obtained, which was stirred at 20° C. for 1 h. and then poured into stirred water (500 ml) containing hydrochloric acid (10 ml). A solid began to separate from the solution. Cooling to 4° C. for 1 h. completed the separation of orange solid (probably a di-mesylated hydrazine which was discarded). The residual aqueous solution was extracted with ethyl acetate (5×200 ml) and the extract dried over anhydrous magnesium sulphate. Removal of the solvent afforded a yellow powder which was slurried with dichloromethane to remove a small amount of the orange impurity. The yield of pale beige product (m.p. 180°-182° C.) was 13.2 g, 82%. TLC analysis (1:1 ethyl acetate: 40°-60° petrol) showed one spot, and spectroscopic data confirms the structure.

$C_6H_8N_4O_4S$: Requires: C 31.0%, H 3.45%, N 24.1%. Found: C 30.6%, H 3.4%, N 24.2%.

Preparation 3 (Method 2)

N'-(2-phenyl-4-quinazolinyl)-p-toluenesulphonyl hydrazide hydrochloride

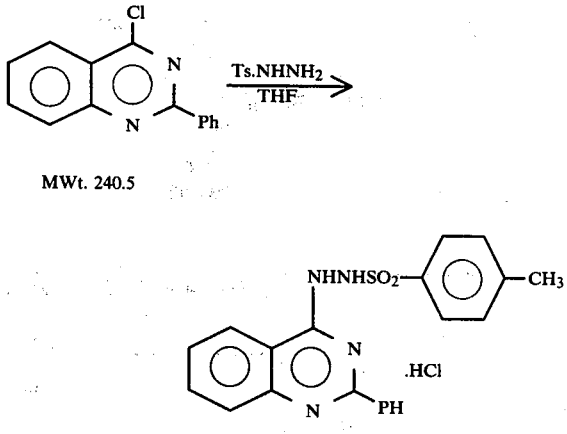

MWt. 240.5

MWt. 426.5

(a) 4-Chloro-2-phenylquinazoline (2.29 g, 9.5 mmole) was dissolved in dry tetrahydrofuran (30 ml) and mixed with a solution of tosylhydrazine (1.86 g, 10 mmole) in dry tetrahydrofuran (10 ml). The mixture was refluxed for 2 h. and allowed to stand at room temperature overnight. The creamy-yellow solid was filtered off, washed with tetrahydrofuran and air dried to afford the pure product, 4.04 g, 100%. TLC analysis (EtOAc) showed the product to be pure and spectroscopic data confirmed the structure. m.p. 230°-232° C. (dec).

$C_{21}H_{18}N_4O_2S.HCl$: Requires: C 59.1%, H 4.45%, N 13.1%. Found: C 58.8%, H 4.8%, N 13.3%.

Preparation 4 (Method 2)

N'-(4-Quinazolinyl)methanesulphonylhydrazide hydrochloride

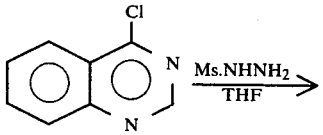

MWt. 164.5

-continued

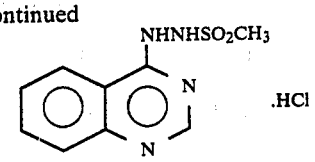

MWt. 274.5

4-Chloro-quinazoline (0.70 g, 4.27 mmole) was added to a solution of mesylhydrazine (0.47 g, 4.27 mmole) in dry tetrahydrofuran (30 ml), the mixture refluxed for 3 h, then stood at 25° C. overnight. The yellow solid was filtered off, washed with tetrahydrofuran and air dried. The yield of pure product was 0.93% g, 79%. TLC analysis (EtOAc) and spectroscopic data showed the product to be pure, m.p. 207°–209° C.

$C_9H_{10}N_4O_2S.HCl$: Requires: C 39.3%, H 4.0%, Cl 12.9% N 20.4%, S 11.7%. Found: C 39.1%, H 4.1%, Cl 12.7%, N 20.5%, S 11.3%.

Preparation 5

N'-(5-Nitro-2-pyridyl)acethydrazide

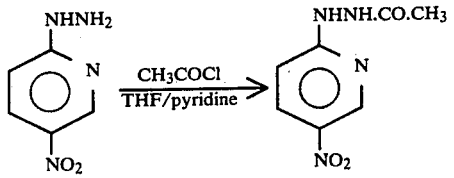

MWt. 154 MWt. 196

Acetyl chloride (0.51 g, 6.5 mmole) was added dropwise to a stirred solution of 2-hydrazino-5-nitropyridine (1.0 g, 6.5 mmole) in tetrahydrofuran (20 ml). Pyridine (0.51 g, 6.5 mmole) was added, the mixture stirred for 0.5 h, and then poured into water (200 ml). The aqueous solution was extracted with ethyl actate, the extract dried ($MgSO_4$) and the solvent removed under reduced pressure. Recrystallisation of the residue from 1,2-dichloroethane afforded the pure product, 1.1 g, 86%, as a cream coloured solid, m.p. 226°–227° C.

$C_7H_8N_4O_3$: Requires: C 42.9%, H 4.1%, N 28.6%. Found: C 42.9%, H 3.9%, N 28.2%.

Preparations 6–34

Further hydrazides were prepared by either Method 1 or Method 2 illustrated in Preparations 1–4 above. Each compound was used as developing agent in the photographic testing procedure described in Example 5 below. The maximum density and photographic speed were each measured and the compounds' relative activity as a colour developing agent was assessed therefrom. Full details are recorded below in Table III.

TABLE III

Sulphonylhydrazide Developers Prepared by Methods (1) and (2)

| No. | Structure | Method & Yield (%) | Relative* Activity | m.p. (°C.) | Fd. Reqd. | C | H | N | S | Other |
|---|---|---|---|---|---|---|---|---|---|---|
| 6 | 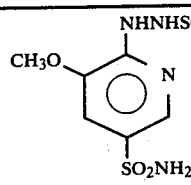 | (1) 46 | v. poor | 314–215 | Fd. Reqd. | 28.6 28.4 | 4.0 4.05 | 18.6 18.9 | 20.9 21.6 | |
| 7 | 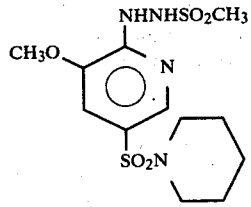 | (1) 44 | fair | 163–170 (dec) | Fd. Reqd. | 39.4 39.6 | 5.4 5.5 | 15.3 15.4 | 17.7 17.6 | |
| 8 | 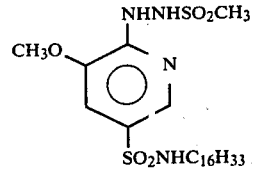 | (1) 90 | poor | 140–141 | Fd. Reqd. | 53.1 53.1 | 8.2 8.5 | 10.6 10.8 | 12.0 12.3 | |
| 9 | 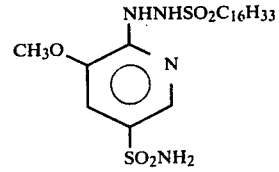 | (1) 83 | v. poor | 170–173 | Fd. Reqd. | 52.8 52.2 | 8.4 8.3 | 10.4 11.1 | 12.0 12.65 | |

TABLE III-continued
Sulphonylhydrazide Developers Prepared by Methods (1) and (2)
| No. | Structure | Method & Yield (%) | Relative* Activity | m.p. (°C.) | Fd. Reqd. | C | H | N | S | Other |
|---|---|---|---|---|---|---|---|---|---|---|
| 10 | 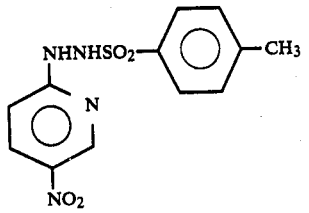 | (1) 65 | v. good | 209–210 | Fd. Reqd. | 47.15 46.75 | 4.0 3.9 | 17.7 18.2 | 10.2 10.4 | |
| 11 | 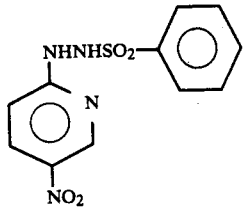 | (1) 78 | v. good | 201–202 | Fd. Reqd. | 44.6 44.9 | 3.5 3.4 | 19.4 19.05 | 10.5 10.9 | |
| 12 | 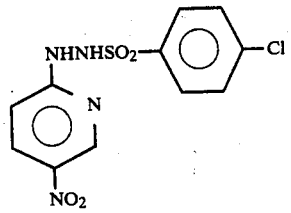 | (1) 57 | v. good | 210–211 | Fd. Reqd. | 40.0 40.2 | 2.85 2.7 | 17.2 17.05 | 9.6 9.7 | |
| 13 | 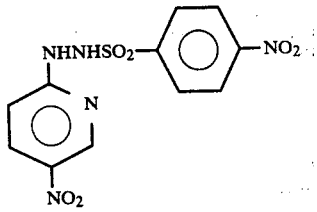 | (1) 57 | v. good | 206–207 | Fd. Reqd. | 38.9 38.9 | 2.7 2.65 | 20.65 20.65 | 9.1 9.4 | |
| 14 | 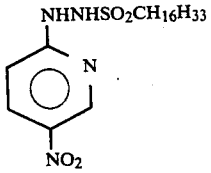 | (1) 79 | fair | 103–106 | Fd. Reqd. | 56.25 57.0 | 8.5 8.6 | 12.9 12.7 | 7.0 7.2 | |
| 15 | 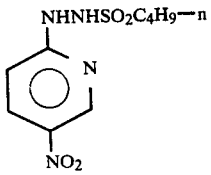 | (1) 77 | v. good | 126–127 | Fd. Reqd. | 40.3 39.4 | 5.0 5.1 | 20.5 20.6 | 11.0 11.7 | |
| 16 | 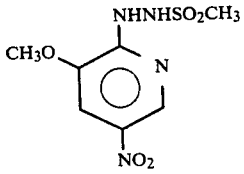 | (1) 48 | v. good | 224–225 | Fd. Reqd. | 32.0 32.1 | 3.7 3.8 | 21.4 21.4 | 11.8 12.2 | |

TABLE III-continued
Sulphonylhydrazide Developers Prepared by Methods (1) and (2)
| No. | Structure | Method & Yield (%) | Relative* Activity | m.p. (°C.) | Fd. Reqd. | C | H | N | S | Other |
|---|---|---|---|---|---|---|---|---|---|---|
| 17 | 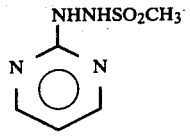 | (1) 67 | good | 177–178 | Fd. Reqd. | 31.2 31.9 | 4.1 4.3 | 28.9 29.8 | 15.7 17.0 | |
| 18 | 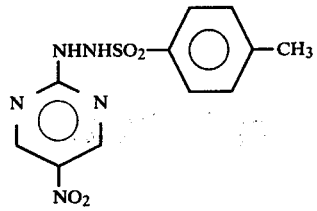 | (2) 93 | v. good | 246–247 | Fd. Reqd. | 42.5 42.7 | 3.7 3.6 | 22.2 22.65 | | |
| 19 | 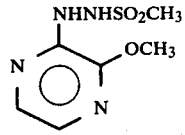 | (1) 71 | fair | 156–158 | Fd. Reqd. | 33.35 33.0 | 4.6 4.6 | 25.6 25.7 | 14.3 14.7 | |
| 20 | 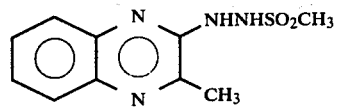 | (1) 88 | good | 215–216 | Fd. Reqd. | 47.6 47.6 | 4.8 4.8 | 22.0 22.2 | 12.35 12.7 | |
| 21 | 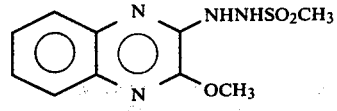 | (1) 83 | good | 250–251 | Fd. Reqd. | 45.1 44.8 | 4.6 4.5 | 20.2 20.9 | 11.7 11.9 | |
| 22 | 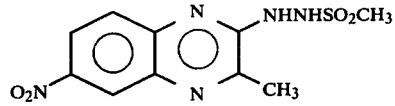 | (1) 7 | v. good | 222–223 | Fd. Reqd. | 40.5 40.4 | 3.8 3.7 | 23.5 23.6 | 10.7 10.8 | |
| 23 | 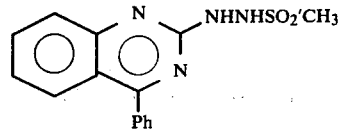 | (1) 50 | poor | 193–194 | Fd. Reqd. | 56.8 57.3 | 4.5 4.5 | 17.0 17.8 | 10.1 10.2 | |
| 24 | 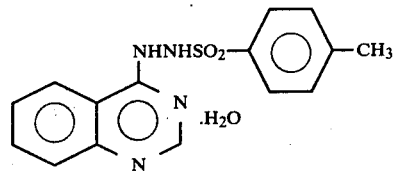 | (2) 65 | v. good | 180–182 | Fd. Reqd. | 54.95 54.2 | 4.75 4.8 | 16.6 16.9 | 9.1 9.6 | |
| 25 | 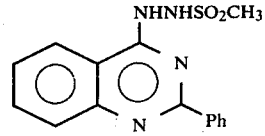 | (1)53 (2)47 | v. good | 214–218 | Fd. Reqd. | 57.2 57.3 | 4.5 4.5 | 17.7 17.8 | 9.7 10.2 | |
| 26 | 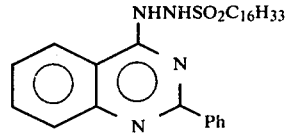 | (1) 45 | good | 107–108 | Fd. Reqd. | 68.1 68.7 | 8.0 8.4 | 10.9 10.7 | 5.9 6.1 | |

TABLE III-continued
Sulphonylhydrazide Developers Prepared by Methods (1) and (2)
| No. | Structure | Method & Yield (%) | Relative* Activity | m.p. (°C.) | Fd. Reqd. | C | H | N | S | Other |
|---|---|---|---|---|---|---|---|---|---|---|
| 27 | 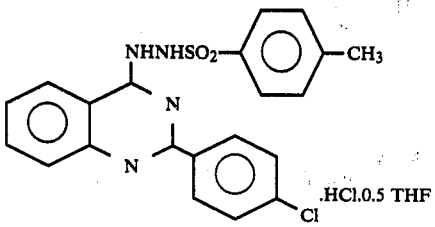 | (2) 92 | good | 300–310 (dec) | Fd. | 55.1 | 4.4 | 11.2 | | Cl 14.0 |
| | | | | | Reqd. | 55.4 | 4.4 | 11.2 | | Cl 14.3 |
| 28 | 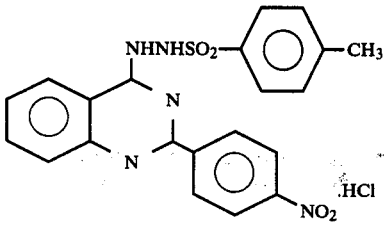 | (2) 90 | good | 270–280 (dec) | Fd. | 53.6 | 4.1 | 14.6 | | |
| | | | | | Reqd. | 53.5 | 3.8 | 14.85 | | |
| 29 | 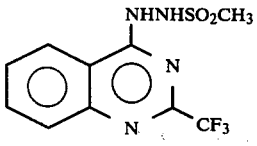 | (2) 16 | v. good | 255–256– (dec) | Fd. | 39.8 | 3.0 | 18.6 | 10.6 | F 18.5 |
| | | | | | Reqd. | 39.2 | 2.9 | 18.3 | 10.5 | F 18.6 |
| 30 | 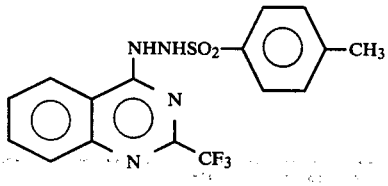 | (2) 66 | v. good | 201.5–202.5 | Fd. | 49.4 | 3.4 | 14.0 | | |
| | | | | | Reqd. | 50.3 | 3.4 | 14.6 | | |
| 31 | 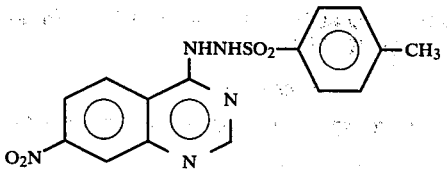 | (2) 50 | good | 235–236 (dec) | Fd. | 49.1 | 3.7 | 19.5 | | |
| | | | | | Reqd. | 50.1 | 3.6 | 19.5 | | |
| 32 | 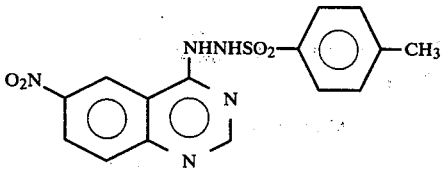 | (2) 77 | good | 211–212 (dec) | Fd. | 44.9 | 3.6 | 17.5 | 8.2 | |
| | | | | | Reqd. | 45.6 | 3.5 | 17.7 | 8.1 | |
| 33 | 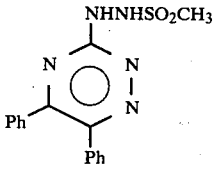 | (1) 50 | v. good | 208–210 | Fd. | 55.3 | 4.3 | 20.2 | 9.6 | |
| | | | | | Reqd. | 56.3 | 4.4 | 20.5 | 9.4 | |
| 34 | 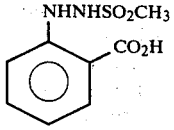 | (1) 45 | v. poor | 191–192 | Fd. | 41.9 | 4.3 | 11.9 | 14.1 | |
| | | | | | Reqd. | 41.7 | 4.35 | 12.2 | 13.9 | |

TABLE III-continued

Sulphonylhydrazide Developers Prepared by Methods (1) and (2)

| No. | Structure | Method & Yield (%) | Relative* Activity | m.p. (°C.) | Fd. Reqd. | C | H | N | S | Other |
|---|---|---|---|---|---|---|---|---|---|---|
| 35 | 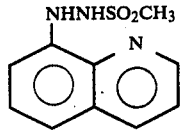 | (1) 39 | fair | 111–2 | Fd. Reqd. | 50.6 50.6 | 4.8 4.6 | 17.5 17.7 | 13.4 13.5 | |
| 36 | 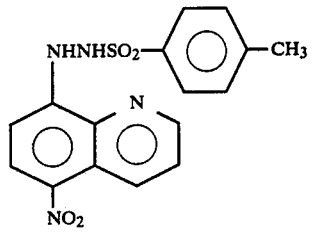 | (1) 35 | fair | 207–8 | Fd. Reqd. | 53.7 53.6 | 4.1 3.9 | 15.3 15.6 | 8.9 8.8 | |
| 37 | 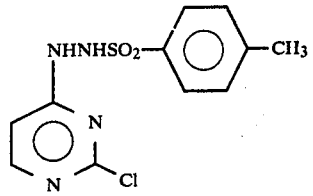 | (2) 8 | good | 200–1 | Fd. Reqd. | 44.5 44.2 | 3.9 3.7 | 18.2 18.7 | 10.8 10.7 | |
| 38 | 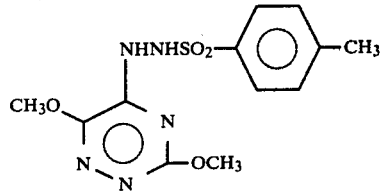 | (2) 70 | v. good | 170–3 | Fd. Reqd. | 44.3 44.3 | 4.6 4.6 | 21.7 21.5 | | |

*Relative Activity—This relates to the relative ease with which dyes can be formed from the sulphonylhydrazides and a standard coupler

COLOUR COUPLERS

Preparation 35

N-Hexadecylcyanoacetamide

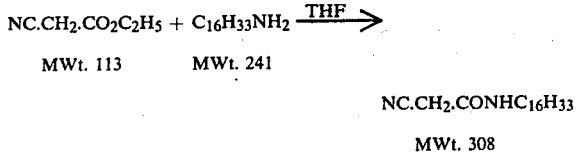

A mixture of ethyl cyanoacetate (22.6 g, 0.2 mole), hexadecylamine (48.2 g, 0.2 mole), and tetrahydrofuran (200 ml) was refluxed for 1 h. and stirred overnight at room temperature to afford a white precipitate, 27.4 g. The filtrate was stirred for two days to afford a second crop of white precipitate, 11.5 g. The total yield of N-hexadecylcyanoacetamide was 38.9 g, 63% m.p. 95.5°–96.5° C. Spectroscopic data was consistent with the product.

$C_{19}H_{36}N_2O$: Requires: C 74.0%, H11.7%, N 9.1%, Found: C74.4%, H 11.65%, N 8.9%.

Other couplers prepared by a similar route are:

N-[4-(2,4-di-t-pentylphenoxy)butyl]cyanoacetamide.

N-{4-[2-(cyanoacetamide)ethyl ]phenyl }-3-(2,4-di-t-pentylphenoxy) butanoamide.

Requires: C 73.66%, H 8.51%, N 8.32%. Found: C 73.56%, H 8.83%, N 7.88%.

Preparation 36

N-(3-hydroxyphenyl) hexadecylsulphonamide

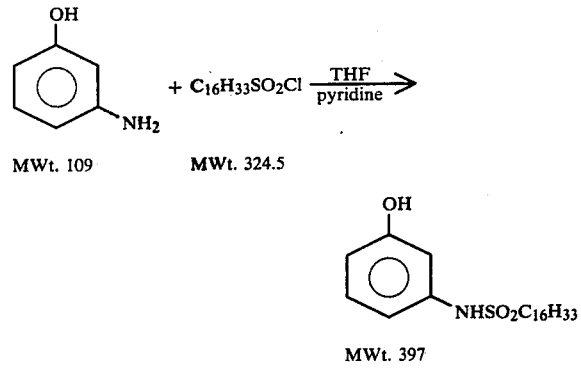

Hexadecyl sulphonyl chloride (9.74 g, 30 mmole) in tetrahydrofuran (20 ml) was added portionwise to a stirred solution of 3-aminophenol (3.77 g, 34.6 mmole) in tetrahydrofuran (15 ml) and pyridine (15 ml). The mixture was stirred for 2.5 h. and then poured into 1NHCl solution (600 ml). The crude product was filtered off, washed with water and dried, 11.66 g. Short column chromatography (Florisil/ether) gave the pure product, m.p. 90.5°-91.5° C., was white flakes, 9.75 g, 82%. Spectroscopic data confirmed the structure. "Florisil" is a trade mark.

$C_{22}H_{39}NO_3S$: Requires: C 66.5%, H 9.8%, N 3.5%. Found: C66.75%, H 9.7%, N 3.5%.

Other couplers prepared by a similar route are:

N-(3-hydroxy-4-methylphenyl) hexadecylsulphonamide $C_{23}H_{41}NO_3S$: Requires: C 67.15%. H 10.0%, N3.3%, S 7.6%.

N-(5-hydroxy-2-methylphenyl) hexadecylsulphonamide $C_{23}H_{41}NO_3S$: Requires: C 67.15%, H 10.0%, N 3.4%. Found: C 66.7%, H 10.0%, N 3.2%.

N-[3-(3-hydroxybenzenesulphamoyl)phenyl]-2-(3-t-butyl-4-hydroxyphenoxy)tridecanoamide $C_{36}H_{50}N_2O_6S$: Requires: C 67.7%, H 7.8%, N 4.4%. Found: C 67.2%, H 7.7%, N 4.28%.

N-[3-(3-hydroxybenzenesulphamoyl)phenyl]pentadecanoamide $C_{28}H_{42}N_2O_4S$: Requires: C 66.9%, H 8.4%, N 5.6%. Found: C 67.2%, H 8.4%, N 5.6%.

N-(3-hydroxyphenyl)-2,4,6-triisopropylbenzenesulphonamide $C_{21}H_{29}NO_3S$: Requires: C 67.2%, H 7.7%, N 3.7%. Found: C 66.8%, H 7.6%, N 3.8%.

N-(2-hydroxyphenyl)hexadecylsulphonamide

Requires: C 66.50,%, H 9.82%, N 3.53%, S 8.06%. Found: C 66.26%, H 9.69%, N 3.58%, S 8.02%.

N-(4-hydroxyphenyl)hexadecylsulphonamide

Requires: C 66.50%, H 9.82%, N 3.53%, S 8.06%. Found: C 66.14%, H 9.96%, N 3.57%, S 7.96%.

Preparation 37

N-Hexadecyl-3,5-dihydroxybenzamide (i)

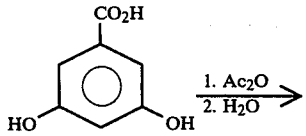

MWt. 154

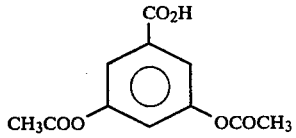

MWt. 238

3,5-Dihydroxybenzoic acid (30.8 g, 0.2 mole) was refluxed with acetic anhydride (50 ml) for 15 minutes, cooled and poured into stirred water (500 ml). The mixture was brought to the boiling point and the clear solution allowed to cool overnight at 4° C. The product was obtained as white needles, m.p. 154°-156° C., 35.0 g. 74%. Spectroscopic data was consistent with the product.

$C_{11}H_{10}O_6$: Requires: C 55.5%, H 4.2%. Found: C 55.7%, H 4.3%.

(ii)

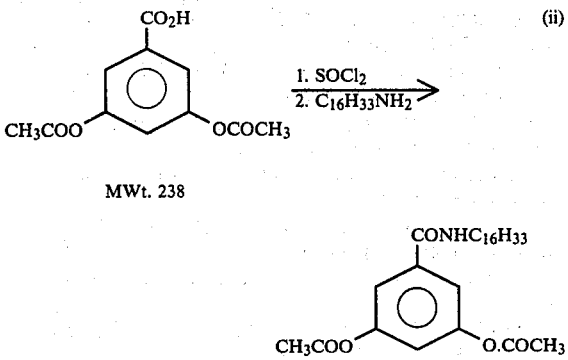

MWt. 238

MWt. 461

3,5-Diacetoxybenzoic acid (17.0 g, 71.4 mmole) was added to thionyl chloride (50 ml) and heated under refulx for 30 minutes. Excess thionyl chloride was removed by vacuum distillation. Dichloromethane was added to the residue (50 ml) and then evaporated (helps to remove last traces of thionyl chloride). On cooling, the pale straw coloured liquid solidified to a mass of needles. This was used as such in the next stage. The acid chloride was dissolved in tetrahydrofuran (100 ml) and a solution of hexadeclyamine (34.4 g, 142.8 mmole) in tetrahydrofuran (430 ml) added in one portion with vigorous stirring. After 15 minutes the amine hydrochloride was filtered off and washed with tetrahydrofuran. The combined filtrate was washings were evaporated to approximately 300 ml and the poured into 1N hydrochloric acid (3l). The product was obtained as a fine white precipitate which was filtered off, washed with water and dried, 28.82 g, 82%, m.p. 100°-102° C.

$C_{27}H_{43}NO_5$: Requires: c 70.3%, H 9.3%, N 3.0%. Found: C 69.8%, H 9.5%, N 2.7%.

(iii)

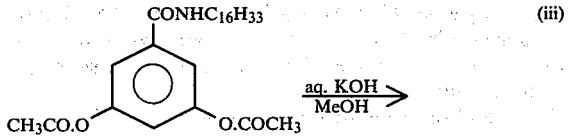

MWt. 461

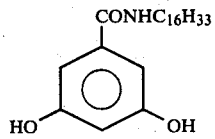

MWt. 377

N-Hexadecyl-3,5-diacetoxybenzamide (28.8 g, 62.5 mmole) was suspended in methanol (500 ml) and purged with nitrogen. A similarly purged solution of potassium hydroxide in water (35 g, 0.625 mole in 50 ml) and methanol (100 ml) was added to the suspension with stirring, and stirred for 2 h. under nitrogen. The resulting solution was poured into 1N hydrochloric acid (5l) and the white precipitate filtered off, washed and dried. The product was recrystallised from aqueous ethanol (200 ml $H_2O$+130 ml ethanol) to afford pure product, 22.11 g, 94%, m.p. 122°-124° C. TLC analysis (EtOAc) showed one spot and spectroscopic data was consistent.

$C_{23}H_{39}NO_3$: Requires: C 73.2%, H 10.3%, N 3.7%. Found: C 73.4%, H 10.4%, N 3.7%.

Other couplers prepared by a similar route are:

N-Hexadecyl-2,4-dihydroxybenzamide, m.p. 85°-86° C.

$C_{27}H_{39}NO_3$: Requires: C 73.2%, H 10.3%, N 3.7%. Found: C 72.8%, H 10.7%, N 3.6%.

N-Hexadecyl-2-(4-hydroxy-1-naphthoxy)propionamide, m.p. 72°-73° C.

$C_{29}H_{45}NO_3$: Requires: C 76.5%, H 9.9%, N 3.1%. Found: C 76.45%, H 9.8%, N 3.0%.

N-Hexadecyl-3-hydroxy-2-naphthamide, m.p. 98°-100° C.

$C_{27}H_{41}NO_2$: Requires: C 78.8%, H 10.0%, N 3.4%. Found: C 78.5%, H 10.0%, N 3.0%.

Preparation 38

N-Hexadecyl-4-hydroxynaphthalene-1-sulphonamide (i)

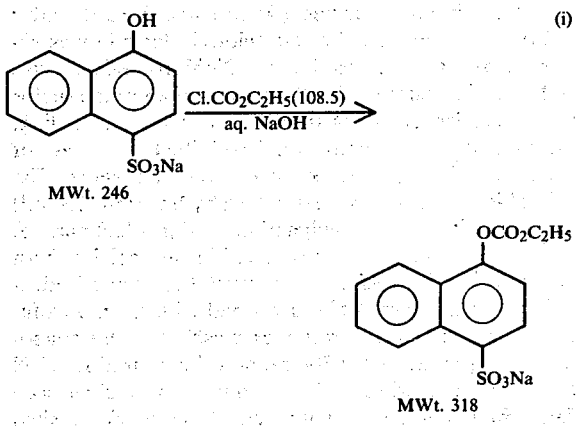

Sodium 4-hydroxynaphthalene-1-sulphonate (50 g, 0.205 mole) was dissolved in 5% aqueous sodium hydroxide solution (200 ml, 0.25 mole) and stirred at 0° C. while ethyl chloroformate (24.3 g, 0.225 mole) was added dropwise. The mixture was stirred at 0°-5° C. for 5 h, during which time a solid precipitated out of solution. The grey solid was filtered off and dried at 60° C. under vacuum.

The yield of crude material was 50.24 g, 77%.

(ii)

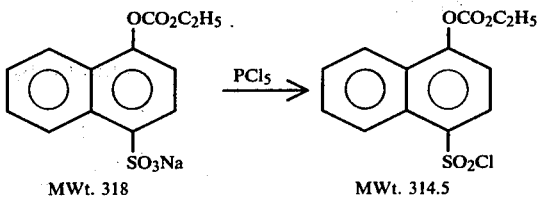

Crude sodium 4-ethoxycarbonyloxynaphthalene-1-sulphonate (50 g, 0.157 mole) and phophorus pentachloride (100 g, excess) were intimately mixed and heated on a steam bath with stirring for 0.5 h, and the poured onto crushed ice-water (3l) while still warm. After stirring for 0.5 h, the sticky olive coloured solid was filtered off, dissolved in dichloromethane, washed with water, and dried over magnesium sulphate.

The dichloromethane solution was reduced in volume and passed through a short column (Florisil-$CH_2Cl_2$) to afford a yellow solution. Evaporation of the solvent gave pure product as a pale yellow crystalline mass, 40,4 g, 82%. TLC analysis ($CH_2Cl_2$) showed one spot ($R_f$=0.9) and spectroscopic data was consistent with the required product.

(iii)

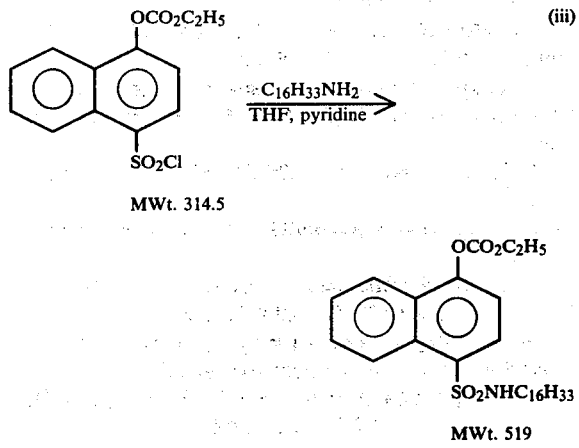

4-Ethoxycarbonyloxy-1-naphthalenesulphonyl chloride (40.0 g, 128.5 mmole) was dissolved in tetrahydrofuran (100 ml) and a solution of hexadecylamine (31.0 g, 128.5 mmole) amd pyridine (10.2 g, 129 mmole) in tetrahydrofuran (200 ml) was added with stirring. The mixture was stirred for 2 h, filtered, and the filtrate poured into water (3l) containing concentrated hydrochloric acid (20 ml). The gum that was obtained was dissolved in ethyl acetate, washed and dried. The solvent was removed, (TLC analysis 1:3 EtOAc :petrol) showed several products at this stage—though one was predominant) and the residue crystallised twice from methanol to afford a beige solid, 22.76 g, 34%. The product had a purity of ~95% by spectroscopic criteria.

(iv)

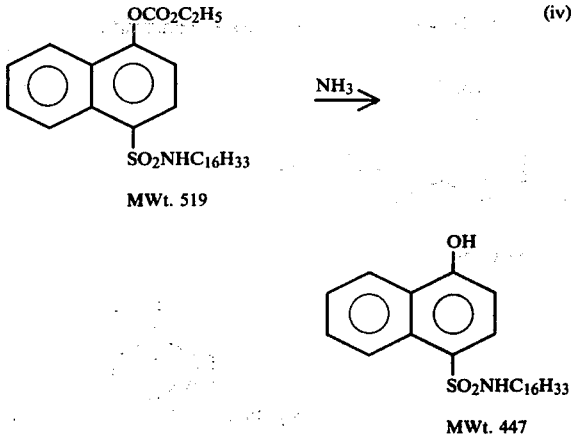

4-Ethoxycarbonyloxy-N-hexadecylnaphthalene-1-sulphonamide (21.5 g, 41.4 mmole) was added to liquid ammonia (250 ml), in portions with stirring, at −78° C. (acetone-drycold bath). The mixture was stirred for 1 h, and the excess ammonia allowed to evaporate. The residue was dissolved in ethyl acetate, washed with water and dried ($MgSO_4$). Removal of the solvent gave a pale brown oil which was dissolved in hot dichloromethane (100ml) and then cooled in an ice-bath. The off-white precipitate was collected and dried in air to yield pure N-hexadecyl-4-hydroxynaphthalene-4-sulphonamide, 7.7 g, 42%. TLC analysis (1:3 EtOAc :

40°–60° petrol) showed one spot ($R_f$=0.4) and spectroscopic data was consistent with the product.

$C_{26}H_{41}NO_3S$: Requires C 69.8%, H 9.2%, N 3.1%. Found: C 69.9%, H 9.1%, N 3.2%.

Preparation 39

N,N-dioctadecyl-5-benzenesulphonamido-1-hydroxy-2-naphthamide (i)

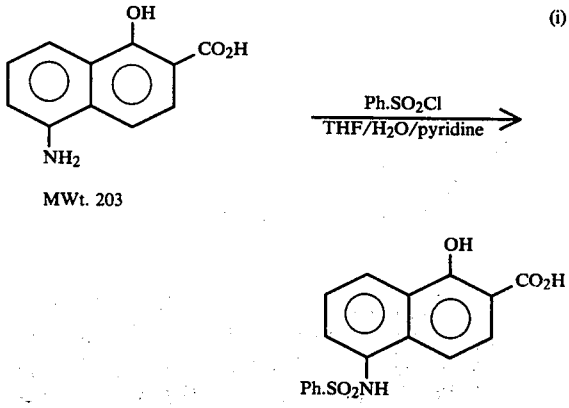

MWt. 203

MWt. 343

5-Amino-1-hydroxy-2-naphthoic acid (20.3 g, 0.1 mole) was dissolved in tetrahydrofuran (500 ml), water (50 ml) and pyridine (15.8 g, 0.2 mole). Benzene sulphonyl chloride (20 g, 15 ml, 0.113 mole) was added with stirring. The mixture was stirred for 3 h, poured into vigorously stirred 1N hydrochloric acid (6l) and the grey precipitate filtered off, washed with water and dried. The yield of product was 23 g, 67%. TLC analysis (5% HOAc in EtOAc) showed one spot (blue fluorescence) and spectroscopic data was consistent with the proposed structure.

$C_{17}H_{13}NO_5S$: Requires: C 59.5%, H 3.8%, N 4.1%. Found: C 59.1%, H 3.9%, N 4.0%.

(ii)

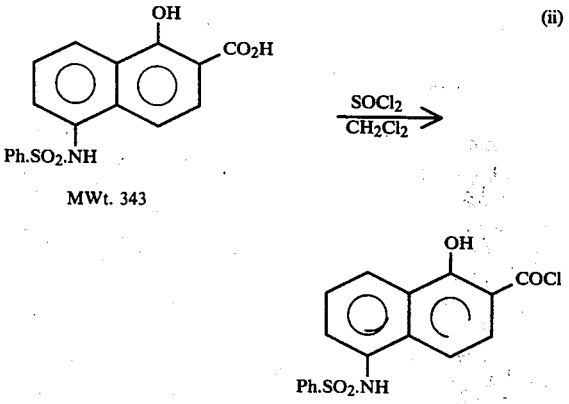

MWt. 343

MWt. 361.5

5-Benzenesulphonamido-1-hydroxy-2-naphthoic acid (22.0 g, 64 mmole) was suspended in a mixture of dry methylene chloride (500 ml), thionyl chloride (17 ml, 236 mmole) and dimethyl formamide (1ml). The mixture was stirred and heated under reflux for 2 h. The solution was cooled and refrigerated for 1 h. The precipitated acid chloride was filtered off, washed with dry methylene chloride until the washings were pale yellow, and dried at 40° C. under vacuum. The yield of product was 16.21 g, 70%, A sample dissolved in hot methanol and subjected to TLC analysis (2:1 EtOAc :petrol) showed one major spot ($R_f$=0.8, run as ester) and a small amount of dark baseline material. The product was used crude in the next stage.

(iii)

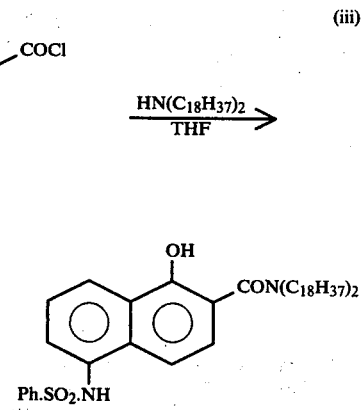

MWt. 361.5

MWt. 521

5-Benzenesulphonamido-1-hydroxy-2-naphthoyl chloride (8.0 g, 22.1 mmole, crude) was suspended in dry tetrahydrofuran (50 ml) and dioctadecylamine (23 g, 44.2 mmole) in warm tetrahydrofuran (100 ml) added with stirring. A thick precipitate was obtained which was stirred overnight. The amine hydrochloride was removed by filtration, washed with tetrahydrofuran and the washings combined with the filtrate. Removal of the solvent gave a dark oil which was taken up in ether and passed through a Florisil plug to remove dark baseline material. The eluate was evaporated to dryness and chromatographed on a Florisil column. A minor impurity (note 1) was removed with methylene chloride: 40°–60° petrol (1:1) and the product was isolated using ether as eluant. The yield of pure product was 2.6 g, 14%. TLC analysis ($CH_2Cl_2$) showed one spot ($R_f$=0.5). Spectroscopic data was consistent with the proposed structure.

$C_{53}H_{86}N_2O_4S$: Requires: C 75.2%, H 10.2%, N 3.3.%. Found: C 75.2%, H 10.1%, N 3.3%.

Note 1: The impurity was identified as N-octadecyl-5-benzenesulphonamido-1-hydroxy-2-naphthamide.

Preparation 40

N-Hexadecyl-1-acetyl-2,1-benzisoxazolone-4-carboxamide

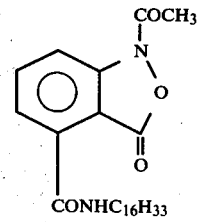

The title compound was prepared by the method described by J. M. Woolley in British Specification No. 778,089 (1957).

Preparation 41

2-Acetyl-3-hydroxy-6-methyl-2H-pyrazolo[3,4-b]pyridine

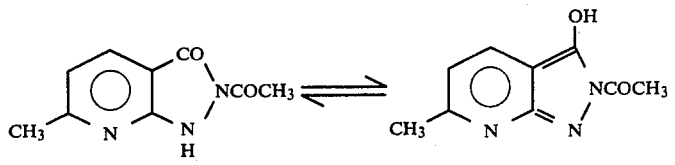

(a) 2-Hydroxy-6-methyl-nicotinic acid (3.6 g, 0.02 m) was heated at 125° for 2 hours with phosphorus oxychloride (10 ml). The reaction mixture was poured onto ice, the solid was collected and crystallised from aqueous ethanol to give colourless fine needles of 2-chloro-6-methylnicotinic acid (72%).

$C_7H_6ClNO_2$: Requires: C 49.0%, H 3.5%, Cl 20.7%, N 8.2%. Found: C 49.15%, H 3.8%, Cl 20.85%, N 8.5%.

The n.m.r. spectrum (DMSO) showed signals at δ 2.58 (Ar.$CH_3$, singlet). 7.40 (1H, doublet), 8.12 (1H, doublet), 10.38 (COOH, broad peak).

Molecular ion $^m/e$ 171.

(b) 2-Chloro-6-methyl nicotinic acid (3.5 g, 0.02 m) was refluxed with hydrazine hydrate (5 ml) and absolute alcohol (20 ml) for 5 hours. The solid was separated, washed with alcohol and crystallised from water to yield 50% of 2-hydrazino-6-methylnicotinic acid.

$C_7H_9N_3O_2$: Requires: C 50.3%, H 5.4%, N 25.4%. Found: C 50.4%, H 5.5%, N 25.5%.

The n.m.r. spectrum (DMSO) showed signals at δ 2.37 ($CH_3$-Ar, singlet), 6.42 (1H, singlet), 6.86 (NH.$NH_2$, broad peak), 7.90 (1H, doublet), 9.60 (COOH, broad peak).

Molecular ion $^m/e$ 167.

(c) 2-Hydrazino-6-methyl nicotinic acid (1.7 g, 0.01 m) was refluxed with water (5 ml) and concentrated hydrochloric acid (10 ml) for 5 hours. The solution was concentrated to one third of the original volume, cooling gave yellow fine needles of 3-hydroxy-6-methyl-1H-pyrazolo[3,4-b]pyridine (58%) as the hydrochloride.

$C_7H_8ClN_3O$: Requires: C 45.3%, H 4.3%, Cl 19.1% N 22.7%. Found: C 45.6%, H 4.45%, Cl 19.4%, N 22.8%.

The n.m.r. spectrum (DMSO) showed signals at δ 2.75 ($CH_3$-Ar, singlet), 7.18 (1H, doublet), 8.48 (1H, doublet).

Molecular ion $^m/e$ 149.

(d) 3-Hydroxy-6-methyl-1H-pyrazolo[3,4-b] pyridine HCl (2 g) was stirred at room temperature with acetic acid (5 ml) and acetic anhydride (10 ml) for 4 hours in presence of pyridine (2 ml) to give the monoacetylated product, crystallised from aqueous ethanol (49%).

$C_9H_9N_3O_2$: Requires C 56.5%, H 4.7%, N 22.0%. Found: C 56.5%, H 4.7%, N 22.1%.

Molecular ion $^m/e$ 191.

Preparation 42

Ethyl 4-(2,4-di-t-pentylphenoxy)butylcarbamoyl acetate

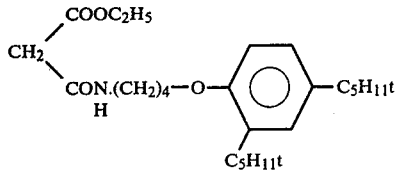

4-(2,4-Di-t-pentylphenoxy)butylamine (3.05 g, 0.01 m) in dry pyridine (20 ml) was cooled to 0°–5° C. in an ice bath. Ethyl malonyl chloride (1.05 g, 0.01 m) was added dropwise keeping the temperature at 0°–5° C. The reaction mixture was stirred at room temperature for 8 hrs. and then was poured onto ice and conc. hydrochloric acid (5 ml). The yellow sticky gum was extracted with ethyl acetate. Thin layer chromatography using eluant ethyl acetate-petroleum ether (40°–60°) (4:1), showed one major spot and baseline material. Column chromatography afforded a yellow liquid which on cooling solidified, (mp 35°) in 75% yield. The product was characterised by its accurate mass spectrum and N.M.R.

$C_{25}H_{41}NO_4$: Requires: C 71.6%; H 9.8%, N 3.3%. Found: C 72.0%, H 10.0%, N 3.7%.

Preparation 43

(i) Ethyl 2-(4-nitrophenylthio)acetate

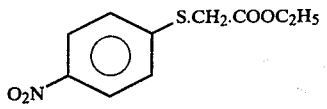

Sodium metal (3.6 g, 0.16 m) was dissolved in ethanol (250 ml) and 4-nitrothiophenol (25 g, 0.13 m) was added to it. To the above mixture was added ethyl chloroacetate (16.0 g). After refluxing for 1 hr, the suspension was filtered. The filtrate was concentrated (50 ml) and allowed to cool, precipitation occurred. The product was collected and dried under vacuum to afford yellow crystals 78% yield, mp. 43°–45° C. It was characterised by spectroscopic analysis.

$C_{10}H_{11}NO_4S$: Requires: C 49.8%, H 4.6% , N 5.8%, S 13.3%. Found: C 49.4%, H 4.6%, N 6.0%, S 13.3%.

(ii) Ethyl 2-(4-nitrophenylsulphonyl)acetate

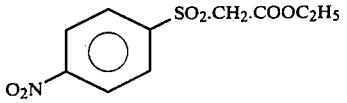

The previous product ester (2.41 g) was dissolved by warming in acetic acid (15 ml) and acetic anhydride (5 ml). It was then cooled in an ice bath (0°-5° C.), hydrogen peroxide (100 vol, 10 ml) was added and stirred for 1 hr. at 0°-5° C. The suspension was then stirred at room temperature for further 2 hrs, after which was poured on to ice and stirred for another half hour. The solid so formed was collected, crystallised from ethanol/40°-60° petrol as colourless needles mp. 76°-77°, 70% yield. The structure was characterised by spectroscopic analysis.

$C_{10}H_{11}NO_6S$: Requires: C 43.9%, H 4.0%, N 5.1%, S 11.7%. Found: C 43.7%, H 3.9%, N 4.9%, S 11.8%.

(iii)

2-(4-nitrophenylsulphonyl)-N-[4-(2,4-di-t-pentylphenoxy)butyl]acetamide

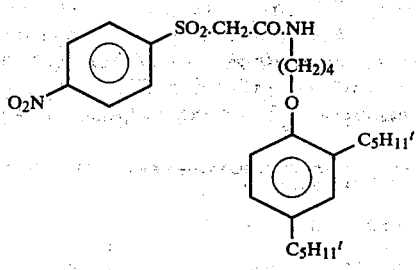

The previous product ester (2.58 g, 0.01 m) and 2,4-di-t-pentylphenoxy-4-butylamine (3.05 g, 0.01 m) was refluxed on a steam bath in tetrahydrofuran (20 ml) for 6 hrs. The solvent was evaporated under vacuum to give a yellow liquid. Column chromatography on silica (ethyl acetate:pet. ether—4:1) afforded a yellow liquid which solidified mp. 36°-37° in 80% yield.

The structure was characterised by spectroscopic analysis.

$C_{28}H_{40}N_2O_6S$: Requires: C 63.2%, H 7.5%, N 5.3%, S 6.0%. Found: C 63.4%, H 7.8%, N 5.6%, S 6.3%.

The following Examples are included for a better understanding of the invention. The following words used therein are trade marks: Araldite, Alkanol, Ektalux and Tinuvin.

EXAMPLE 1

Metallisable dyes from unballasted couplers

A convenient test-tube method for evaluating unballasted couplers consists of dissolving the coupler and developer in 10% sodium carbonate solution, and adding excess potassium persulphate. The oxidised colour developer couples to give the unmetallised azo dye. After 30 seconds, a strip of mordant coating (shown in structure A) is then dipped in the reaction mixture and the azo dye is mordanted and metallised. The strip is washed briefly in running water and then dried. A number of metallised azo dyes formed this way are shown in Tables A and B. Couplers which have the desired activity and give the desired hues can be incorporated in a colour developer composition or can be ballasted and incorporated into the photographic layer (see Example 2)

| Coating A (g/sq. meter) | |
|---|---|
| Mordant 1 | 2.152 |
| Gelatin | 2.152 |
| Hardener 2 | 0.215 |
| $NiSO_4$ | 0.58 |
| Gelatin | 1.08 |
| Hardener 2 | 0.108 |

-continued

| Coating A (g/sq. meter) | |
|---|---|
| HCHO | 0.108 |
| Polyethylene terephthalate film base | |

Mordant 1 - poly(1-vinylimidazole) partially quaternised (10%) with 2-chloroethanol Hardener 2 - Araldite Diluent DY 022 - 1,4-butane diol-di-glycidyl ether.

TABLE A

Dyes formed on mordant (coating A) using nitropyridylsulphonylhydrazide, Structure 3, Table I and various unballasted couplers.

| | Coupler | Hue | λ max (nm) | HBW (nm) |
|---|---|---|---|---|
| (a) | ethylacetoacetate | orange/yellow | 475 | 79 |
| (b) | ethylcyanoacetate | lemon/yellow | 456 | 64 |
| (c) | citrazinic acid | magenta | 542 | 83 |
| (d) | m-dimethylamino-phenol | deep magenta | 568 (shoulder 540) | 79 |
| (e) | 3,5-dihydroxy benzoic acid | magenta | 548 | 93 |
| (f) | 2-methyl resorcinol | magenta | 535 | 95 |
| (g) | resorcinol | magenta | 535 | 96 |
| (h) | m-hydroxy benzoic acid | blue cyan | 600 (shoulder 555) | 89 |
| (i) | naphthol type (see below) | cyan | 627 | 106 |
| (j) | hydroxynaphthalene 5-sulphonic acid | blue | 590/628 double peaks | 130 |
| (k) | 2-nitroresorcinol | magenta | 544 | 96 |
| (l) | cyanoacetic acid | lemon/yellow | 454 | 74 |
| (m) | acetyl acetone | orange | 486 | 62 |

Coupler (i)

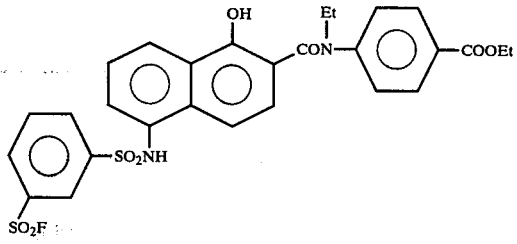

TABLE B

Dyes formed on mordant (coating A using the quinoxaline sulphonylhydrazide, Structure 11 Table 1.

| Coupler | Hue | λmax (nm) | HBW (nm) |
|---|---|---|---|
| Indole | red magenta | 542 | 115 |
| 4,5-diphenyl-imidazole | deep magenta | 515 shoulder 625 | 194 |
| Citrazinic acid | deep magenta | 557 | 85 |

EXAMPLE 2

Metallisable dyes from ballasted couplers

A coupler dispersion was made by the following method:

| | | |
|---|---|---|
| Solution A | | |
| Test Coupler | 7.0 g | heat to 60-100° C. |
| Coupler solvent[3] | See Table C | |
| 2-butoxyethoxyethyl acetate | 16.0 g | |
| Solution B | | |

-continued

| | | |
|---|---|---|
| 12½% Gelatin | 56.6 g | heat to 50° C. |
| Di-isopropyl naphthalene sulphonate solution* | 9.6 g | |

*100 g liter$^{-1}$ Alkanol XC, 62.5 cm$^3$.liter$^{-1}$ methanol 3: The coupler-solvent and coupler to solvent ratio varied depending on the solubility of the coupler.

The solvents were:

tri cresyl phosphate—$S_1$ dibutyl phthalate—$S_2$

N,N-diethyl lauramide—$S_3$

Solution A was added slowly to solution B using ultrasonic agitation and the mixture was homogenised for 2 min. The resulting dispersion was cooled, noodle-washed at pH 6.0 for 6 hrs. (4° C.) and made up to 100 g wt. pH 5.0. The final dispersion was 7% coupler and 7% gelatin.

Dispersions of the following couplers were made:

TABLE C

| Structure (Table II) | Coupler:Solvent wt. ratio |
|---|---|
| 1,2 | $S_1$, 1:1 |
| 9–17 | $S_3$, 1:1 |
| 18 | $S_3$, 1:2 |
| 19–24 | $S_3$, 1:1 |
| 26 | $S_1$, 1:½ |
| 28 | $S_3$, 1:1 |

The couplers were tested in a single layer coating in the following format:

| Coating B (g/sq. meter) | |
|---|---|
| gelatin | 0.60 |
| Hardener 4 | 0.06 |
| gelatin | 2.0 |

-continued

| Coating B (g/sq. meter) | |
|---|---|
| cubic AgCl emulsion | (0.3 μm edge) |
| antifoggant 5 | 600 mg/mole |
| Hardener 4 | 0.02 |
| Coupler | 0.001 mole |
| Antistatic polyethylene terephthalate | |

Hardener 4: bis-(vinyl sulphonyl methyl)ether
Antifoggant 5: 1-(3-acetamido phenyl)-5-mercapto-tetrazole (Na salt)

Three fogged strips of the coating were developed in a solution of the sulphonylhydrazide developer (approx. 10 mg developer in 5 cm$^3$ 10% $Na_2CO_3$ solution) for 0.5–5 min. (21° C.) The strips were then rinsed in 10% carbonate solution for 0.5 min. to remove retained developer from the coating, washed 2'(30° C.), bleach-fixed 2'(ferric EDTA bleach fix) and washed 2'(30° C.). One strip was then dried and its spectrum taken—this represented the unmetallised form of the dye. The other strips were metallised for 2–5 min. (21° C.) in a nickel or copper metallising bath of the following composition:

| | |
|---|---|
| $NiSO_4 7H_2O$ or $CuSO_4 5H_2O$ | 10 g |
| water | 60 cm$^3$ |
| 0.880 $NH_3$ solution | 20 cm$^3$ |
| $Na_2CO_3$ | 4.0 g |
| water | 120 cm$^3$ |

washed 10 min (30° C.) and dried. A 10 min. wash was used to ensure that the Biuret stain formed between the metal and gelatin in the coating was decomposed. The spectrophotometric data on a number of dyes formed with the couplers listed in Table C and three sulphonylhydrazide developers is given in Tables D, E and F.

TABLE D

Dyes formed in photographic coating (B) using nitropyridylsulphonylhydrazide - Structure 3, R = $CH_3$ Table I. Entries under λmax in parentheses indicate the position of a "shoulder" in Tables D–F.

| Coupler Structure [Table II] | Type | λmax (nm) Dye | Dye + Ni | Dye + Cu | HBW-Dye + (nm) Ni |
|---|---|---|---|---|---|
| 1 | Pivaloylacetanilide | — | 482 | — | — |
| 2 | Cyanoacetamide | 461 | 468 | 453 | — |
| 9 | Malonic ester/Amide | 356 | 455 | 426 | 82 |
| 10 | Sulphonylacetamide | 475 (455) | 462 | 437 | 91 |
| 11 | Malonamide | — | 464 | 437 | 87 |
| 12 | Sulphamoylacetamide | — | 430 | — | — |
| 13 | Phenol | 402 (536) | 677 (570) | — | 192 |
| 14 | p-Cresol | 409 | 583 (417) | 550, 442 | — |
| 15 | o-Cresol | 426 (563) | 561 | — | — |
| 17 | α-Naphthol | 451 | 606 | 602 | 150 |
| 18 | β-Naphthol | 600 | 605 (562) | — | — |
| 19 | α-Naphthol | 497 | 595 | 632 | 96 |
| 20 | α-Naphthol | 569 (603) | 639 | — | — |
| 21 | Dihydroxy benzamide | 420 (550) | 554 | — | 109 |
| 22 | Dihydroxy benzamide | 420, 589 (550) | 537 | 537 | 146 |
| 23 | Phenol | — | 640 | 635 | — |
| 24 | α-Naphthol | 465 | 591 | 591 | 101 |
| 26 | Pyrazolone | 477 | 472 | — | 107 |
| 28 | Pyrazolotriazole | 458 | 522 | 458 | 187 |

TABLE E

Dyes formed in photographic coating (B) using quinoxaline sulphonylhydrazide - Structure 11 Table I.

| Coupler Structure [Table II] | Type | λmax (nm) Dye | Dye + Ni | Dye + Cu | HBW Dye + Ni (nm) |
|---|---|---|---|---|---|
| 1 | Pivaloylacetanilide | 394 | 490 | — | 86 |
| 2 | Cyanoacetamide | 449 | 473 | 474 | 80 |
| 9 | Malonic ester/amide | 357 | 473 | 465 | 77 |
| 10 | Sulphonylacetamide | 375 | 472 | 467 | 82 |
| 11 | Malonamide | — | 473 | 465 | 86 |
| 12 | Sulphamoylacetamide | — | — | — | — |
| 13 | Phenol | 430 | 622, 582 | — | 137 |
| 14 | p-Cresol | 449 | 565 (600) | — | 155 |
| 15 | o-Cresol | 454 | 634 | 584 | 136 |
| 17 | α-Naphthol | 578 | 608 | 602 | 104 |
| 18 | β-Naphthol | 499 (615) | 635 (582) | — | 126 |
| 19 | α-Naphthol | 523 | 673 | 654 | 107 |
| 20 | α-Naphthol | 620 (580) | 642, 593 | — | — |
| 21 | Dihydroxy Benzamide | 430 | 548 | — | 142 |
| 22 | Dihydroxy Benzamide | 440 | 556 (591) | 565 | 157 |
| 23 | Phenol | — | 662 | 642 | — |
| 24 | α-Naphthol | 563 | 602 | 574 | 107 |
| 26 | Pyrazolone | 475 | 484 | — | 106 |
| 28 | Pyrazolotriazole | 496 | 560 | 518 | — |

TABLE F

Dyes formed in photographic coating (B) using quinazoline sulphonylhydrazide - Structure 10 Table I.

| Coupler Structure [Table II] | Type | λmax (nm) Dye | Dye + Ni | Dye + Cu | HBW Dye + Ni (nm) |
|---|---|---|---|---|---|
| 1 | Pivaloylacetanilide | 488 | 388 | — | — |
| 2 | Cyanoacetamide | 380 | 448 | 443 | 80 |
| 9 | Malonic Ester/Amide | 365 | 442 | 416 | 76 |
| 10 | Sulphonylacetamide | 373 | 445 | 432 | 80 |
| 11 | Malonamide | — | 445 | 422 | — |
| 12 | Sulphamoylacetamide | — | 425 | — | — |
| 13 | Phenol | 429 | 540 | — | 120 |
| 14 | p-Cresol | 442 | 535 | 525 | 134 |
| 15 | o-Cresol | 443 | 528 | 530 | 138 |
| 17 | α-Naphthol | 525 | 584 | 590 | 176 |
| 18 | β-Naphthol | 530, 500 | 608 (565) | — | 119 |
| 19 | α-Naphthol | 500 | 647 | 627 | 108 |
| 20 | α-Naphthol | 492 | 622 | 576 | 117 |
| 21 | Dihydroxy Benzamide | 430 | 520 | 520 | 122 |
| 22 | Dihydroxy Benzamide | 427 | 552 | 542 | 130 |
| 23 | Phenol | 530 | 634 | 620 | 155 |
| 24 | α-Naphthol | 515 | 572 | 552 | 113 |
| 26 | Pyrazolone | 452 | 465 | — | 98 |
| 28 | Pyrazolotriazole | 482 | 497 | 514 | 102 |

EXAMPLE 3

Samples of the dye formed between developer 10, Table I and coupler 14, Table II were prepared as outlined in Example 2 but were metallised in the following solutions for 2 minutes and then washed 10 mins. (30° C.)

| | |
|---|---|
| Solution 1 Ni/$NH_3$ | |
| $NiSO_4 7H_2O$ | 0.025 g |
| 0.880 $NH_3$ | 2.32 g |
| Water | 20 $cm^3$ |
| Water to 30 $cm^3$ | pH 11.65 |
| Solution 2 Ni/ethanolamine | |
| $NiSO_4 7H_2O$ | 0.025 g |
| ethanolamine | 1.30 g |
| Water | 20 $cm^3$ |
| Water to 30 $cm^3$ | pH 11.37 |
| Solution 3 Ni/diethanolamine | |
| $NiSO_4 7H_2O$ | 0.25 g |
| diethanolamine | 2.24 g |

-continued

| | |
|---|---|
| Water | 20 $cm^3$ |
| Water to 30 $cm^3$ | pH 10.55 |

The spectrophotometric curves of the dyes were very similar as indicated in Table G.

TABLE G

Metallisation of dye formed from developer 10, Table I and coupler 14, Table II.

| Solution No. | λmax nm | HBW nm | Absorbance at 425 nm | 535 nm | 650 nm |
|---|---|---|---|---|---|
| unmetallised | 445 | 130 | .91 | .26 | .06 |
| 1 | 534 | 134 | .23 | 1.00 | .13 |
| 2 | 530 | 138 | .26 | 1.00 | .12 |
| 3 | 536 | 132 | .23 | 1.00 | .10 |

Metallisation is also possible at low $Ni^{++}$ levels (approx. 0.02%) and with other complexing agents instead of ammonia or an ethanolamine.

EXAMPLE 4

Two samples of the dye formed between developer 7 Table I and coupler 14 Table II were prepared as outlined in Example 2 but were metallised in the following solutions for 2 min. at 21° C. and washed 2 minutes.

| | |
|---|---|
| Solution A | |
| $NiSO_4 7H_2O$ | 10 g |
| Water | 60 $cm^3$ |
| 0.880 $NH_3$ | 20 $cm^3$ |
| $Na_2CO_3$ | 4.0 g |
| Water to | 120 $cm^3$ |
| Solution B | |
| $NiSO_4 7H_2O$ | 10 g |
| Water | 60 $cm^3$ |
| 0.880 $NH_3$ | 20 $cm^3$ |
| CTAB (cetyltrimethyl-ammonium bromide) | 10 g |
| $Na_2CO_3$ | 4.0 g |
| Water to | 120 $cm^3$ |

The presence of the CTAB in the metallising solution resulted in a much sharper absorption curve as indicated in Table H.

TABLE H

| | Effect of CTAB | | | | |
|---|---|---|---|---|---|
| | λmax | HBW | Absorbance at | | |
| Solution No. | nm | nm | 425 nm | 535 nm | 650 nm |
| unmetallised | 445 | 130 | 0.91 | 0.26 | 0.06 |
| A | 535 | 137 | 0.26 | 1.00 | 0.10 |
| B | 537 | 102 | 0.13 | 1.00 | 0.04 |

EXAMPLE 5

Metallisable dyes from a range of sulphonyl hydrazide developers with common coupler 24 Table II.

35 mm strips of coating B containing coupler 24, Table II were exposed to a 0.3 log E increment step wedge. The strips were than developed for 1½ and 4½ mins. at 30° C. in a solution of the following composition:

| Developer | |
|---|---|
| Water | 833 $cm^3$ |
| $K_2CO_3$(anhyd) | 30 g |
| NaCl | 5 g |
| $Na_2SO_3$ | 1 g |
| Benzyl alcohol | 10 $cm^3$ |
| Sulphonyl hydrazide developer | 0.015 M |
| Water to | 1000 $cm^3$, pH 12.7 (27° C.) with KOH |

After development the strips were treated as follows:

| | | |
|---|---|---|
| Wash | | 30 sec. |
| Ferric EDTA bleach fix | 2' | (21° C.) |
| Wash | 3' | (30° C.) |
| Metallisable $Ni/NH_3$* | 1½' | (21° C.) |
| Wash | 5' | (30° C.) |

*Solution A, Example 4.

From the resulting step wedge, Dmax/Dmin, and speed parameters were measured and the spectrophotometric curve of the metallised azo dye was also taken.

The results are shown in Table J. A fairly wide range of dyes was observed (λmax 536–618 nm) using the naphthol coupler. The dyes would probably be bidentate complexes with nickel.

TABLE J

Sensitometry of sulphonylhydrazide developers, pH 12.3; Coupler 24 Table II (dyes metallised $Ni/NH_3$)

| Developer Structure Table I | Dye Dmax* 1½'/4½' | Speed (D = 0.2) 1½'/4½' | 1½'/4½' | λmax | HBW nm |
|---|---|---|---|---|---|
| 1 | 1.19/1.20(R) | 201/218 | .06/.07 | 618 | 112 |
| 6 | 1.75/1.87(G) | 219/230 | .07/.30 | 553 | 125 |
| 4 | 0.08/0.60(R) | —/156 | .03/.03 | 592 | 112 |
| 11 | 0.80/0.80(R) | 179/179 | .04/.05 | 602 | 107 |
| 3, R = 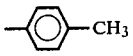 | 1.57/1.54(G) | 228/243 | .19/.36 | 598 | 112 |
| 13 | 1.70/1.78(G) | 231/231 | .13/.48 | 554 | 113 |
| 3, R = $CH_3$ | 1.94/1.84(G) | 222/228 | .22/.52 | 591 | 105 |
| 3, R = 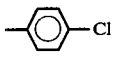 | 1.47/1.49(R) | 220/238 | .07/.11 | 594 | 101 |
| 10 | 1.90/1.96(G) | 227/235 | .10/.14 | 572 | 113 |
| 5 | .92/.90(G) | 180/188 | .15/.41 | 536 | 86 |
| 12 | 1.91/2.05(R) | 233/237 | .26/.29 | 614 | 146 |
| 3, R = 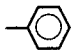 | 1.62/1.54(G) | 238/261 | .09/.14 | 592 | 104 |
| 3, R = 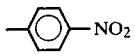 | 1.18/1.16(R) | 224/240 | .09/.15 | 600 | 112 |

*maximum dye density recorded Status A, R or G

EXAMPLE 6

The metallised dyes shown in Table K were prepared as described in Example 2 and faded in a fading device for 400 hrs. The percentage fade from a density of 1.0 shows that a substantial improvement can be obtained by using metallised azo dyes compared with typical unmetallised azamethine dyes.

In the fading device the samples were irradiated from both sides using two Thorn 65/80W north light fluorescent tubes (NL) and two Philips 40W Actinic Blue 05 tubes (UV) arranged so that one of each type of lamp was directed at each side of the sample at a distance of about 6 cm. Each side of the sample was covered with an Ektalux 2B UV filter and the temperature and humidity were controlled to 21° C., 50% RH respectively.

The results are recorded in Table K below.

TABLE K

| Coupler Structure (Table II) | Developer Structure | Dye Form | λmax (nm) | % Fade from D = 1.0 400 hrs (+UV) |
|---|---|---|---|---|
| 2 | XI<br>$R^2 = CH_3$,<br>$R^3 = C_6H_5$<br>$R^9 = H$ | Dye + Ni | 448 | +3 |
| 2 | X<br>$R^2 = CH_3$, $R^9 = H$<br>$R^{10} = CH_3$ | Dye + Ni | 472 | 0 |
| 2 | X<br>$R^2 = CH_3$, $R^9 = NO_2$<br>$R^{10} = CH_3$ | Dye + Ni | 500<br>(470) | +2 |
| 1 | 4-N—ethyl-N(β-methane-sulphonamidoethyl) amino-o-toluidine sesquisulphate (CD3) | Dye | 442 | −15 |
| 24 | IX<br>$R^9 = H$ | Dye + Ni | 526 | −6 |
| 22 | XI<br>$R^2 =$ 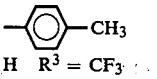 <br>$R^9 = H$ $R^3 = CF_3$ | Dye + Ni | 537 | −1 |
| 15 | XI<br>$R^2 =$ 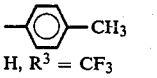 <br>$R^9 = H$, $R^3 = CF_3$ | Dye + Ni | 510 | 0 |
| 26 | CD3 | Dye | 538 | −6 |
| 13 | X<br>$R^2 = CH_3$, $R^9 = H$<br>$R^{10} = CH_3$ | Dye + Ni | 622<br>(580) | +1 |
| 19 | XI<br>$R^2 =$ 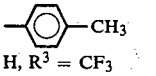 <br>$R^9 = H$, $R^3 = CF_3$ | Dye + Ni | 630 | +1 |
| 19 | X<br>$R^2 = CH_3$, $R^9 = NO_2$<br>$R^{10} = CH_3$ | Dye + Ni | 679<br>(627) | +2 |
| 31 | CD3 | Dye | 640 | −1 |

EXAMPLE 7

Three strips of multilayer coating B were exposed to a four colour step wedge (neutral R, G and B exposures) and processed in the following manner:

(a) Develop. 2½ min. at 30° C.
(b) Water rinse 2 sec.
(c) Stop Bath 30 sec.
(d) Water rinse 2 sec.
(e) Ferric EDTA bleach fix, 2 min. at 21° C.
(f) Wash 5 min. 30° C.
(g) Metallise (Ni) — solution A, 2 min at 21° C.
(h) Wash 10 min 30° C.

The developer solution was varied:

| Developer 1 | |
|---|---|
| Water | 800 ml |
| $K_2CO_3$ | 30 g |
| NaBr | 1.0 g |
| NaCl | 5.0 g |
| $Na_2SO_3$ | 0.20 g |
| Benzyl alcohol | 12.50 g |
| Antifoggant 6 | 0.012 g |
| Sulphonyl hydrazide, structure 10 Table 1 | 2.50 g |
| Water to 1 liter pH, | 11.6 |
| Antifoggant 6: | |
| 4-carboxymethyl-4-thiazoline-2-thione | |

Developer 2

Developer 1+2.0 g/liter bis-pyridinium methyl ether perchlorate.

Developer 3

Developer 1+0.20 g/liter, 4-hydroxymethyl-4-methyl-1-phenyl-pyrazolidin-3-one.

| Coating B (g/sq. meter) | |
|---|---|
| Gel | 1.03 |
| Hardener 4 | 0.011 |
| Gel | 2.05 |
| AgCl/Br (0.27μ) | 0.26 |
| Coupler C ($S_3$, 1:1) | 0.30 |
| Hardener 4 | 0.015 |
| Gel | 1.3 |
| Tinuvin 328 | 0.71 |
| Scavenger 6 ($S_2$, 1:3) | 0.60 |
| Hardener 4 | 0.013 |
| Gel | 1.3 |
| AgCl/Br (0.27μ) | 0.40 |
| Coupler B ($S_3$, 1:1) | |
| Hardener 4 | 0.014 |
| Gel | 0.9 |
| Scavenger 6 ($S_2$, 1:3) | 0.60 |
| Hardener 4 | 0.008 |
| Gel | 2.014 |
| AgCl/Br (0.75μ) | 0.50 |
| Coupler A ($S_1$, 1:1) | 1.08 |
| Hardener 4 | 0.015 |

R.C. PAPER BASE
Scavenger 6: dioctyl hydroquinone
Coupler A: Table II Structure 1
Coupler B: Table II Structure 14
Coupler C: Table II Structure 19

The stop bath (c) had the following composition:

| | |
|---|---|
| Water | 800 ml |
| $K_2CO_3$ | 30 g |
| NaBr | 1.2 g |
| 5-methylbenzotriazole | 0.40 g |
| $Na_2SO_3$ | 4.0 g |
| Water to 1 liter | (pH 11.3) |

The processed sample using developer 1 showed only a weak cyan image. Both developers 2 and 3 showed strong cyan, magenta and yellow images. The sensitometric data is shown in Table L.

TABLE L

| Coating | Process | Speed (neutral at D = 0.7) R | G | B | Dmax R | G | B | Dmin R | G | B |
|---|---|---|---|---|---|---|---|---|---|---|
| Coating B | Developer 1 | — | — | — | .50 | — | — | .28 | .24 | .27 |
| Coating B | Developer 2 | 132 | 155 | 197 | 2.29 | 2.54 | 2.33 | .17 | .16 | .29 |
| Coating B | Developer 3 | 183 | 178 | 197 | 2.43 | 2.49 | 2.27 | .16 | .16 | .21 |
| Control | See below | 194 | 190 | 190 | 2.36 | 2.34 | 2.52 | .11 | .11 | .11 |

The sulphonyl hydrazide developers can be used to process a full colour multilayer at low pH (11.6). The addition of a development accelerator or ETA is not as necessary at higher pH levels.

The Control Coating was like Coating B except that the Coupler B and C were replaced by Couplers of Structure Table II Structure 26 and Table II Structure 31 respectively. The control coating was processed in the C41 process described in the British Journal of Photography Annual 1977 pp. 204–5 (using a p-phenylenediamine colour developer and no metallising step).

We claim:

1. A method of forming a photographic azo or azomethine dye image in an exposed photographic silver halide element, the method comprising the steps of (a) developing the imagewise exposed material to form an imagewise pattern of oxidized color developing agent, then (b) reacting the oxidized color developing agent with a color coupler to produce an image dye, wherein both the color developing agent and the color coupler possess at least one metal chelating site such that the image dye is capable of forming a tri- or higher-dentate metallized dye, and (c) contacting the image dye with polyvalent metal ions to form a metallized image dye.

2. A method of forming a photographic azo or azomethine dye image in an exposed photographic silver halide element, the method comprising the steps of (a) developing the imagewise exposed material to form an imagewise pattern of oxidized color developing agent, (b) reacting the oxidized color developing agent with a color coupler to produce an image dye, wherein both the color developing agent and the color coupler possess at least one metal chelating site such that the image dye is capable of forming a tri- or higher-dentate metallized dye, and wherein the color developing agent is hydrazide of the formula:

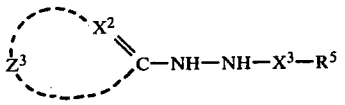

wherein $R^5$ is substituted or unsubstituted alkyl, aryl or heterocyclyl, $X^2$ is —N= or

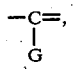

$X^3$ is —CO— or —$SO^2$—, $Z^3$ represents the atoms necessary to complete an aromatic carbocyclic or heterocyclic nucleus, and G is a metal chelating group, a salt thereof, or a hydrolyzable precursor thereof, and, (c) contacting the image dye with polyvalent metal ions to form a metallized dye image.

3. A method as in claim 2 wherein the color developing agent has one of the formulas:

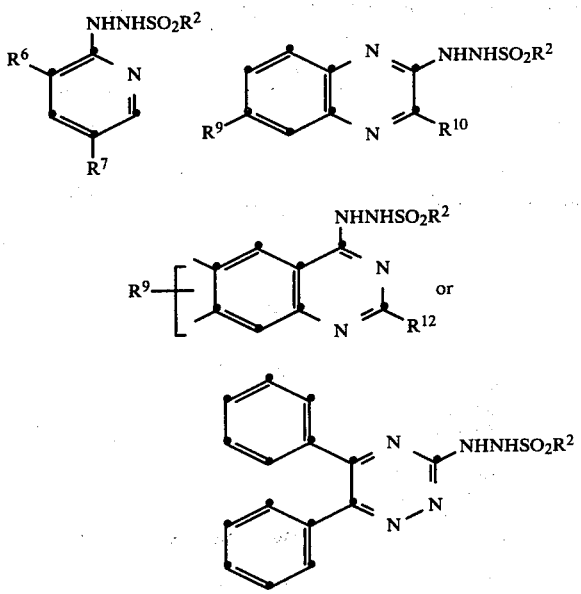

wherein $R^6$ is hydrogen, unsubstituted or substituted alkoxy, $R^7$ is —$NO_2$, —$SO_2R^8$ or —$COR^8$, $R^8$ is a tertiary amino group, $R^9$ is hydrogen or —$NO_2$, $R^{10}$ is alkyl or alkoxy, $R^{12}$ is hydrogen, unsubstituted or substituted alkyl, aryl or heterocyclyl, or —CN, and $R^2$ is unsubstituted or substituted alkyl or aryl.

4. A method as in claim 1 wherein the color coupler is a phenol, naphthal, pyrazolone, pyrazolotriazole, or open chain ketomethylene dye-forming coupler having a metal chelating group attached to a position adjacent the coupling position.

5. A method of forming a photographic azo or azomethine dye image in an exposed photographic silver halide element, the method comprising the steps of (a) developing the imagewise exposed material to form an imagewise pattern of oxidized color developing agent, (b) reacting the oxidized color developing agent with a color coupler to produce an image dye;

wherein both the color developing agent and the color coupler possess at least one metal chelating site such that the image dye is capable of forming a tri- or higher-dentate metallized dye, and wherein the color coupler has the formula:

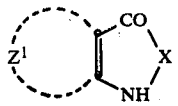

wherein

X is —O— or =NY in which Y is —$COR^1$, —$COOR^1$, —$SO_2R^2$, —$CONR^2R^3$ or —$CSNHR^2$, the residue of X forming a chelating group after coupling, $R^1$ is alkyl of 1 to 4 carbon atoms, $R^2$ is an unsubstituted or substituted or substituted alkyl or aryl, $R^3$ is hydrogen or $R^2$, and $Z^1$ represents the atoms necessary to complete a diffusible or non-diffusible coupler capable of forming a non-diffusible azo or azomethine dye on coupling with oxidized color developing agent; and, (c) contacting the image dye with polyvalent metal ions to form a metallized dye image.

6. A method as in claim 5 wherein the color coupler has the formula:

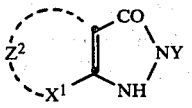

wherein $X^1$ is —N= or

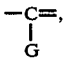

wherein G is a metal chelating group, a salt thereof or a hydrolyzable precursor thereof, Y is —$COR^1$, —$COOR^1$, —$So_2R^2$, —$CONR^2R^3$ or —$CSNHR^2$ wherein $R^1$ is alkyl group of 1 to 4 carbon atoms, $R^2$ is a substituted or unsubstituted alkyl or aryl, $R^3$ is hydrogen or $R^2$, and $Z^2$ represents the atoms necessary to complete a diffusible or non-diffusible coupler capable of forming a non-diffusible azo or azomethine dye on coupling with an oxidized color developing agent.

7. A method as in claim 1 wherein the color coupler is diffusible and is contained in the color developer solution.

8. A method as in claim 1 wherein the color coupler is non-diffusible and is in the photographic element.

9. A method as in claim 1 wherein the metal chelating sites are oxygen or nitrogen atoms capable of forming a coordination complex with metal ions.

10. A method as in claim 1 wherein the metal ions are ions of copper, nickel, chromium, cobalt, manganese or zinc.

11. A method as in claim 1 wherein the metallization is carried out after dye formation using a metallizing solution containing metal ions at a pH within the range of 5.0 to 12.0.

12. A method as in claim 1 wherein the dye formation takes place in the presence of an electron transfer agent or a development accelerator.

13. A method as in claim 1 wherein the photographic silver halide element is a multilayer color element comprising image-forming units sensitive to blue, green and red light, respectively, and capable of forming yellow, magenta and cyan dye images respectively.

14. A method of forming a photographic azo dye image in an exposed photographic silver halide element, the method comprising the steps of (a) developing the imagewise exposed material to form an imagewise pattern of oxidized color developing agent, then (b) reacting the oxidized color developing agent with a color coupler to produce an azo image dye, wherein at least the color developing agent possesses at least one metal chelating site such that the azo image dye is capable of forming a bi-, tri- or higher-dentate metallized dye, and wherein the color developing agent is a hydrazide of the formula:

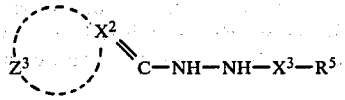

wherein $R^5$ is substituted or unsubstituted alkyl, aryl or heterocyclyl, $X^2$ is —N= or

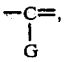

$X^3$ is —CO— or —$SO^2$—, $Z^3$ represents the atoms necessary to complete an aromatic carbocyclic or hereocyclic neculeus, and G is a metal chelating group, a salt thereof, or a hydrolyzable precursor thereof, and, (c) contacting the azo image dye with polyvalent metal ions to form a metallized dye image.

15. A method as in claim 14 in which the color developing agent has one of the formulas:

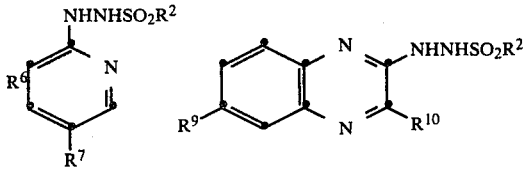

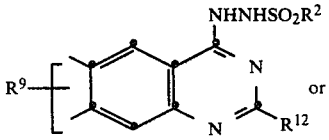

or

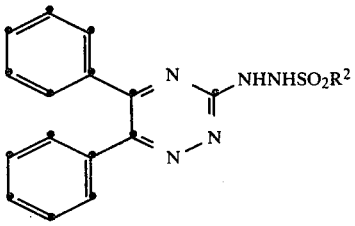

wherein $R^6$ is hydrogen, unsubstituted or substituted alkoxy, $R^7$ is $—NO_2$, $—SO_2R^8$ or $—COR^8$, $R^8$ is a tertiary amino group, $R^9$ is hydrogen or $—NO_2$, $R^{10}$ is alkyl or alkoxy, $R^{12}$ is hydrogen, unsubstituted or substituted alkyl, aryl or heterocyclyl, or —CN, and $R^2$ is unsubstituted or substituted alkyl or aryl.

16. A method as in claim 14 in which the color coupler has the forumla:

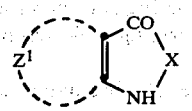

wherein

X is —O— or =NY in which Y is $—COR^1$, $—COOR^1$, $—SO_2R^2$, $—CONR^2R^3$ or $—CSNHR^2$, the residue of X forming a chelating group after coupling, $R^1$ is alkyl of 1 to 4 carbon atoms, $R^2$ is an unsubstituted or substituted alkyl or aryl, $R^3$ is hydrogen or $R^2$, and $Z^1$ represents the atoms necessary to complete a diffusible or non-diffusible coupler capable of forming a non-diffusible azo dye on coupling with oxidized color developing agent; and, (c) contacting the image dye with polyvalent metal ions to form a metallized dye image.

17. A method as in claim 14 in which the color coupler has the formula:

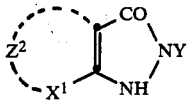

wherein $X^1$ is —N= or

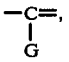

wherein G is a metal chelating group, a salt thereof or a hydrolyzable percursor thereof, Y is $—COR^1$, $—COOR^1$, $—SO_2R^2$, $—CONR^2R$or $—CSNHR^2$ wherein $R^1$ is alkyl of 1 to 4 carbon atoms, $R^2$ is a substituted or unsubstituted alkyl or aryl, $R^3$ is hydrogen or $R^2$, and $Z^2$ represents the atoms necessary to complete a diffusible or non-diffusible coupler capable of forming a non-diffusible azo dye on coupling with an oxidized color developing agent.

18. A processed phtotographic element containing at least one layer containing a metallized dye formed by color coupling development in accordance with claim 1.

* * * * *

UNITED STATES PATENT AND TRADEMARK OFFICE

CERTIFICATE OF CORRECTION

PATENT NO. : 4,481,268

DATED : November 6, 1984

INVENTOR(S) : Joseph Bailey, et al

It is certified that error appears in the above-identified patent and that said Letters Patent are hereby corrected as shown below:

Column 54, lines 45-50, the first structure should read

-- 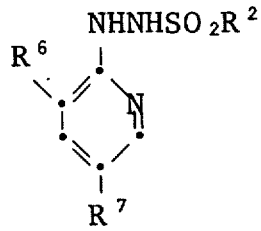

--.

Column 56, line 19, "-CONR $^2$R" should read -- -CONR $^2$R $^3$ --.

Signed and Sealed this

Twenty-second Day of October 1985

[SEAL]

Attest:

DONALD J. QUIGG

Attesting Officer

Commissioner of Patents and Trademarks—Designate